US007116063B2

(12) United States Patent
Ohnishi et al.

(10) Patent No.: US 7,116,063 B2
(45) Date of Patent: Oct. 3, 2006

(54) DIMMABLE DISCHARGE LAMP LIGHTING DEVICE

(75) Inventors: Naoki Ohnishi, Osaka (JP); Shigeru Ido, Osaka (JP)

(73) Assignee: Matsushita Electric Works, Ltd., Osaka (JP)

( * ) Notice: Subject to any disclaimer, the term of this patent is extended or adjusted under 35 U.S.C. 154(b) by 91 days.

(21) Appl. No.: 10/900,081

(22) Filed: Jul. 28, 2004

(65) Prior Publication Data

US 2005/0023995 A1 Feb. 3, 2005

(30) Foreign Application Priority Data

Jul. 28, 2003 (JP) ..... 2003-281143
Jul. 28, 2003 (JP) ..... 2003-281271

(51) Int. Cl.
*G05F 1/00* (2006.01)

(52) U.S. Cl. ..... 315/291; 315/307; 315/209 R

(58) Field of Classification Search ..... None
See application file for complete search history.

(56) References Cited

U.S. PATENT DOCUMENTS

| | | | | |
|---|---|---|---|---|
| 5,925,990 | A * | 7/1999 | Crouse et al. | 315/307 |
| 6,696,798 | B1 * | 2/2004 | Nishimoto et al. | 315/224 |
| 2002/0047604 | A1 * | 4/2002 | Schadhauser et al. | 315/224 |
| 2002/0047608 | A1 * | 4/2002 | Takahashi et al. | 315/224 |

* cited by examiner

*Primary Examiner*—Tuyet Thi Vo
(74) *Attorney, Agent, or Firm*—Bacon & Thomas, PLLC

(57) ABSTRACT

A discharge lamp lighting device includes a high frequency power supply for supplying high frequency power to the discharge lamp via a first impedance element, a DC power supply for applying DC voltage to the discharge lamp via a second impedance element, a dimming control circuit for carrying out a dimming of the discharge lamp by controlling the power supplied to the discharge lamp, a DC voltage detection circuit for detecting a DC component of the voltage applied to the discharge lamp, and an output correction unit for making a correction to the power supplied to the discharge lamp in accordance with a value detected by the DC voltage detection circuit. It can light the discharge lamp stably regardless of a variation in temperature.

11 Claims, 22 Drawing Sheets

DURING AN ORDINARY LIGHTING

AT LOW TEMPERATURE

UNDER A FLICKERING CONDITION

DIMMABLE DISCHARGE LAMP LIGHTING DEVICE

FIELD OF THE INVENTION

The present invention relates to a discharge lamp lighting device; and, more particularly, to a dimmable discharge lamp lighting device.

BACKGROUND OF THE INVENTION

A dimmable discharge lamp lighting device is disclosed in U.S. Pat. No. 5,170,099. This disclosure is directed to provide a discharge lamp lighting device that can stably light a discharge lamp even at a low light flux level of less than 20% of its rated light illumination flux level. The disclosed discharge lamp lighting device includes a low-pressure mercury arc discharge lamp; a high frequency power supply for supplying a high frequency power to the discharge lamp; a dimming control circuit for carrying out a dimming of the discharge lamp from an arc discharge zone to a glow discharge zone; and a DC power supply that supplies to the discharge lamp a DC power at a level capable of maintaining discharge upon a low light flux dimming, the DC power being superposed on the high frequency power.

The above configuration enables stable dimming control of the light of the discharge lamp even at a low illumination level, without being extinguished or darkened under a normal condition.

However, the above conventional device has problems in that the vapor pressure of mercury in the discharge lamp is dependent upon a temperature, and thus the performance thereof is susceptible to the variation of ambient temperature. Especially, a low ambient temperature generally induces an increase in an equivalent impedance of the discharge lamp, which in turn results in the decrease in the DC power that is supplied to the discharge lamp. Consequently, a light flux from the discharge lamp is reduced, and therefore a flickering or an extinguishment of the lamp may occur.

Another dimmable discharge lamp lighting device is disclosed in Japanese Patent No. 3293650, which includes an inverter circuit with variable output for lighting a discharge lamp having a filament; a power detection unit for detecting a voltage in response to an output power of the inverter circuit; an output comparing unit for comparing the voltage detected by the power detection unit and an output reference voltage; a lamp voltage detection unit for detecting a voltage of the discharge lamp; a lamp voltage comparing unit for determining whether a voltage detected by the lamp voltage detection unit is higher than a lamp reference voltage; and an offset unit, in case where the voltage detected by the lamp voltage detection unit is determined to be higher than the lamp reference voltage, for reducing the voltage detected by the power detection unit relatively to the output reference voltage, whereby the reduced voltage is compared with the output reference voltage by the output comparing unit. The above lamp lighting device further includes a control unit. In a normal case, the control unit controls the output power of the inverter circuit depending on an output of the output comparing unit to stabilize the output power of the inverter circuit according to a preset lighting condition of the discharge lamp. However, in case where the lamp voltage detected by the lamp voltage detection unit is determined to be higher than the lamp reference voltage, the control unit controls the output power of the inverter circuit depending on the output of the output comparing unit while relatively reducing the voltage detected by the power detection unit by the offset unit.

In this way, if the voltage of the discharge lamp increases to be higher than the lamp reference voltage, the voltage detected in response to the output power of the inverter circuit is corrected to be lower than the actually detected level, enabling the output power of the inverter circuit to be increased in comparison with a case where the lamp voltage is not higher than the lamp reference voltage, which in turn prevents the discharge lamp from being extinguished.

Since the output of the inverter circuit is increased in case the lamp voltage is higher than the lamp reference voltage, the above conventional dimmable discharge lamp lighting device is considered to be able to prevent the discharge lamp from being extinguished and flickered when a current-voltage characteristic of the discharge lamp is within a negative domain. However, when the optical output of the discharge lamp is lowered down to equal to or less than 10% of the rated level for example, the current-voltage characteristic of the discharge lamp goes into a positive domain. In this case, since a lamp voltage decreases in company with a decrease of a lamp current, the conventional dimmable discharge lamp still suffers from extinguishment and flickering problems.

SUMMARY OF THE INVENTION

It is, therefore, a primary object of the present invention to provide a discharge lamp lighting device capable of lighting a discharge lamp stably without being affected by the variation of the equivalent impedance of the discharge lamp during a low light flux lighting condition.

Another object of the present invention is to provide a discharge lamp lighting device capable of reducing a flickering problem even when an optical output of the discharge lamp is lowered and a current-voltage characteristic goes into a positive domain.

In accordance with the present invention, there is provided a discharge lamp lighting device including a high frequency power supply for supplying high frequency power to the discharge lamp via a first impedance element; a DC power supply for applying a DC voltage to the discharge lamp via a second impedance element; a dimming control circuit for carrying out a dimming of the discharge lamp by controlling the power supplied to the discharge lamp; a DC voltage detection circuit for detecting a DC component of the voltage applied to the discharge lamp; and an output correction unit for making a correction to the power supplied to the discharge lamp in accordance with a value detected by the DC voltage detection circuit.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENTS

A first preferred embodiment in accordance with the present invention is described with reference to FIGS. 1 to 7.

Figure 1:
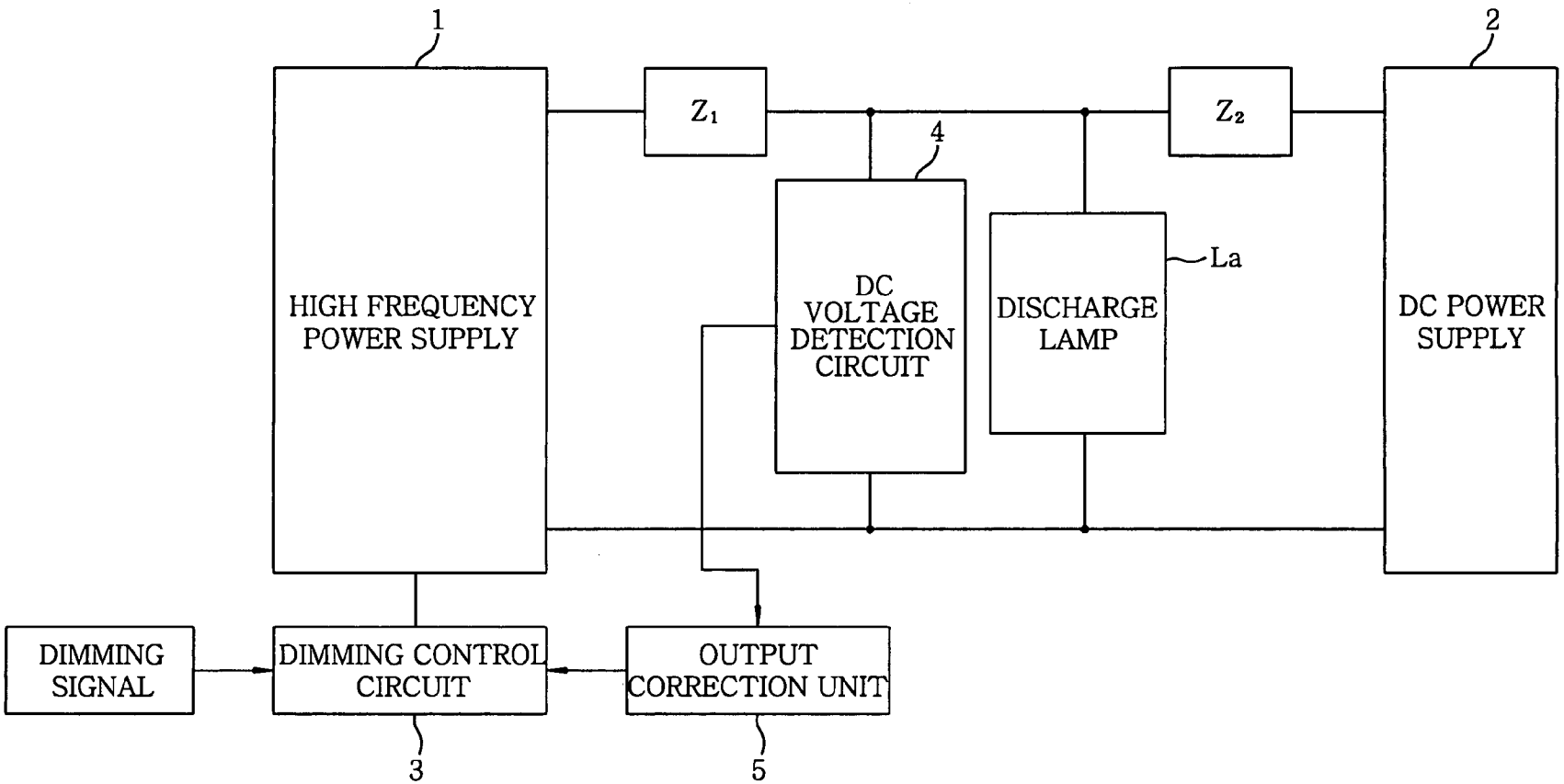
FIG. 1 shows a block diagram in accordance with a first preferred embodiment of the present invention.

Referring to FIG. 1, a discharge lamp lighting device of the preferred embodiment includes a high frequency power supply 1 for supplying a high frequency power to a discharge lamp La via a first impedance element Z1; a DC power supply 2 for applying a DC voltage to the discharge lamp La via a second impedance element Z2; a dimming control circuit 3 for carrying out a dimming of the discharge lamp La by controlling the power supplied to the discharge lamp La; a DC voltage detection circuit 4 for detecting a DC component of voltage applied to the discharge lamp La; and an output correction unit 5 for making a correction to the power supplied to the discharge lamp La in accordance with the value detected by the DC voltage detection circuit 4.

Figure 2:
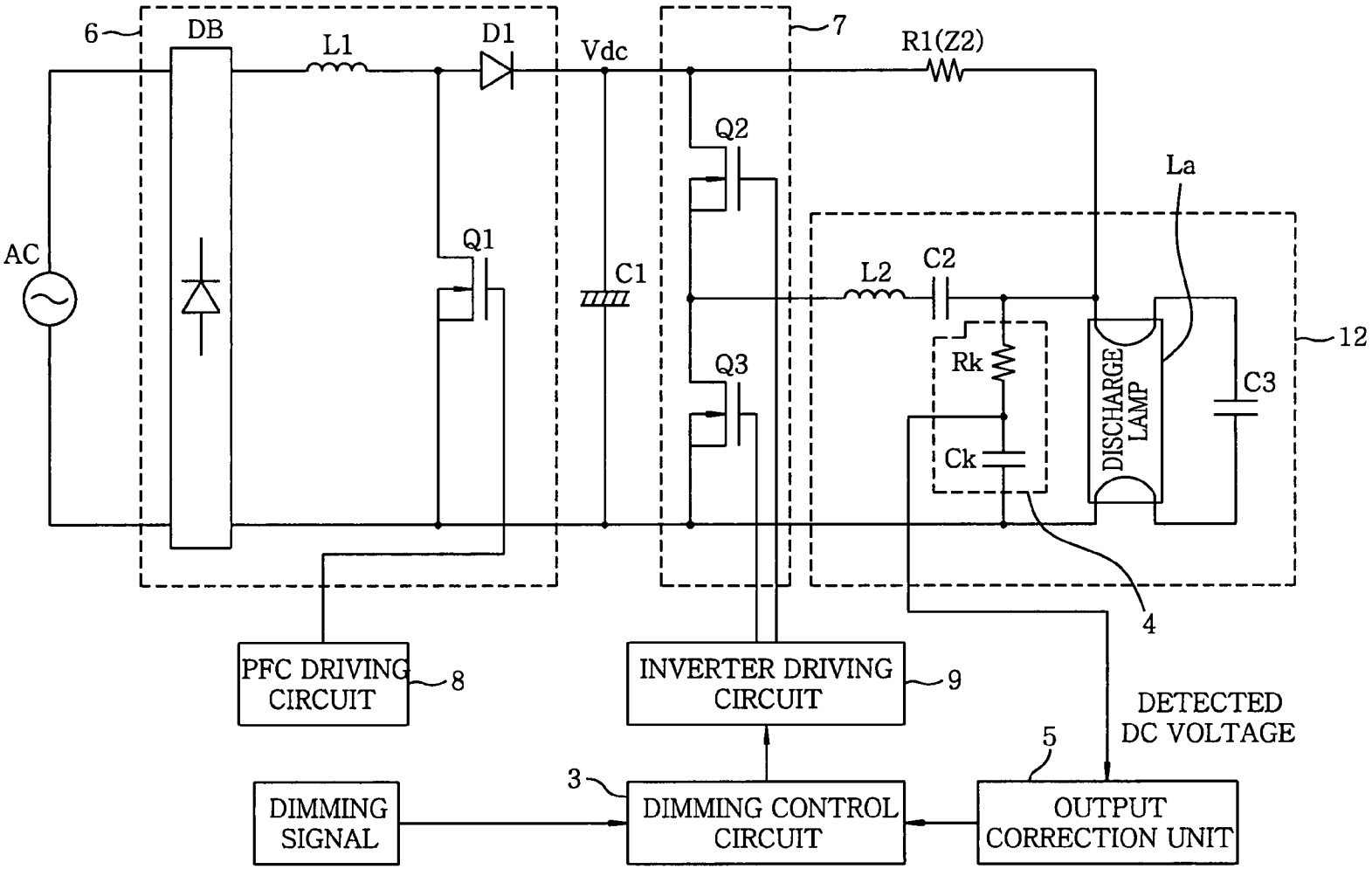
FIG. 2 describes a detailed circuit diagram of the first preferred embodiment.

The block diagram of FIG. 1 may be more concretely configured by a circuit diagram shown in FIG. 2. The first impedance element Z1 has a specific impedance value against a high frequency, and is configured, e.g., to be a series circuit of an inductor L2 and a capacitor C2. The second impedance element Z2 has a specific impedance value against the DC, and is configured, e.g., to be a resistor R1.

The high frequency power supply 1 includes, e.g., a boost chopper circuit 6, an inverter circuit 7, a PFC (Power Factor Correction) driving circuit 8, and an inverter driving circuit 9. To be more specific, a commercial AC power source AC is coupled to a diode bridge DB, and an inductor L1 and a switch element Q1 are in connection with output terminals of the diode bridge DB. The switch element Q1 is implemented by, e.g., a field-effect transistor (FET). And connected to a gate of the switch element Q1 is a PFC driving circuit 8 that switches the switch element Q1. An anode of a diode D1 is connected to a connection node between the switch element Q1 and the inductor L1. And a smoothing capacitor C1 corresponding to the DC power supply 2 is connected in parallel to the switch element Q1 via the diode D1. Between two terminals of the smoothing capacitor C1, a series circuit of a switch element Q2 and a switch element Q3 is connected. Each of the switch elements Q2 and Q3 is implemented by, e.g., an FET just like the switch element Q1. Connected to the respective gates of the switch elements Q2 and Q3 is an inverter driving circuit 9 to switch the switch elements Q2 and Q3 alternately.

Connected to the connection node between the switch element Q2 and the switch element Q3 are an inductor L2 and a capacitor C2 corresponding to the first impedance element Z1. And connected in parallel between a load side of the capacitor C2 and a drain of the switch element Q3 are a series circuit of a resistor Rk and a capacitor Ck corresponding to the DC voltage detection circuit 4 and a parallel circuit of the discharge lamp La and a capacitor C3. And, connected between a cathode of the diode D1 and the connection node between the capacitor C2 and the resistor Rk is a resistor R1 corresponding to the second impedance element Z2.

Connected to the connection node between the resistor Rk and the capacitor Ck is the output correction unit 5 to make a correction to the power supplied to the discharge lamp La in accordance with the value detected by the DC voltage detection circuit 4. And connected to an output terminal of the output correction unit 5 is the dimming control circuit 3 to receive a dimming signal and output an inverter driving signal to the inverter driving circuit 9. The output correction unit 5 includes, e.g., an operational amplifier (not shown in FIG. 2) having a reference power source Vref, which will be described later.

Following is an explanation for an operation of the device in accordance with the above configuration. An AC voltage from the commercial AC power source AC is rectified by the diode bridge DB, and then is boosted by a circuit including the inductor L1, the diode D1 and the switch element Q1 by switching the switch element Q1 under the control of the PFC driving circuit 8. The boosted voltage is outputted as a smoothed DC voltage by the smoothing capacitor C1. The switch elements Q2 and Q3 are alternately turned on and off by a driving signal from the inverter driving circuit 9, thereby converting the DC voltage into a high frequency square wave voltage. The square wave voltage is converted into a high frequency voltage of a substantially sinusoidal waveform by a circuit 12 including the inductor L2, the DC cutting capacitor C2, the resonance capacitor C3, and the discharge lamp La.

Herein, the dimming control of the discharge lamp La is carried by varying the frequency of the driving signal from the inverter driving circuit 9. More specifically, the discharge lamp La is usually dimmed down by reducing the power supplied to the discharge lamp La by way of increasing the frequency of the driving signal to raise the impedance of the inductor L2.

And, superposed to the discharge lamp La is a DC voltage applied between two terminals of the smoothing capacitor C1 corresponding to the DC power supply 2 is superposed to the discharge lamp La via the connection node between the capacitor C2 and the resistor Rk and via the resistor R1 connected to the cathode of the diode D1. Here, the DC voltage detection circuit 4 including the resistor Rk and the capacitor Ck and connected in parallel to the discharge lamp La, functions as a low pass filter (LPF), and therefore, detected between two terminals of the capacitor Ck are only a DC component and a low frequency DC alteration component of the voltage applied between two terminals of the discharge lamp La. The value detected by the DC voltage detection circuit 4 is inputted into the output correction unit 5. If the detected value has, e.g., increased, it is determined that a light flux of the discharge lamp La has been reduced, and therefore, the frequency of the driving signal from the inverter driving circuit 9 is decreased to increase the power supplied to the discharge lamp La. On the contrary, if the detected value has, e.g., decreased, it is determined that a light flux of the discharge lamp La has been raised, and therefore the frequency of the driving signal is increased to decrease the power supplied to the discharge lamp La.

Following is the reason why the DC component between two terminals of the discharge lamp La is detected. The illumination control of the discharge lamp La is carried out in accordance with the dimming signal, and when the illumination ratio decreases, the impedance of the discharge lamp La increases exponentially. The term "the illumination ratio" used herein denotes a ratio of current light illumination flux level to the rated (or full) light illumination flux level of the discharge lamp La. If the high frequency voltage from the high frequency power supply 1 does not include a DC component, the DC voltage component ($DC_{component}$) between two terminals of the discharge lamp La can be represented as:

$$DC_{component} = DC_{power} \times \frac{Z_{La}}{Z_2 + Z_{La}}, \quad \text{Eq. 1}$$

wherein $DC_{power}$ is the voltage of the DC power supply 2, $Z_{La}$ is an impedance of the discharge lamp La, and $Z_2$ is an impedance of the second impedance element Z2. Therefore, if the voltage of the DC power supply 2 and the impedance of the second impedance element Z2 are constant or known values, the impedance of the discharge lamp La can be estimated by detecting the DC voltage component between two terminals of the discharge lamp La. Since the impedance of the discharge lamp La increases exponentially as described above, a small change in the illumination ratio results in a large variation of the DC voltage component during the low light flux lighting condition. For this reason, a small variation in the characteristics of the discharge lamp La can be detected with high accuracy in accordance with the embodiment of the present invention, in comparison with the case of detecting a current or a voltage of the discharge lamp La itself.

For example, if the discharge lamp La is a fluorescence lamp, the impedance thereof can be increased to tens to hundreds of KΩ when the illumination is so low that the relative illumination ratio becomes as low as 5%. In such a case, by setting the impedance of the second impedance element Z2 to be hundreds of KΩ to several MΩ, the impedance of the discharge lamp La can be detected with high accuracy.

Figure 3A:
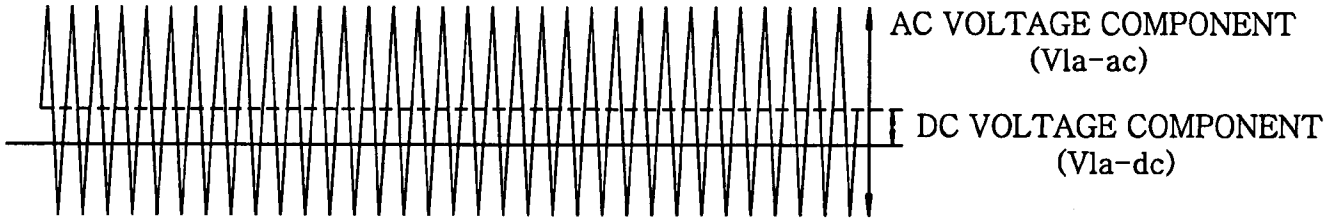
FIGS. 3A to 3C provide waveforms of an AC voltage component and a DC voltage component of the preferred embodiment during a low light flux lighting condition.
Figure 3B:
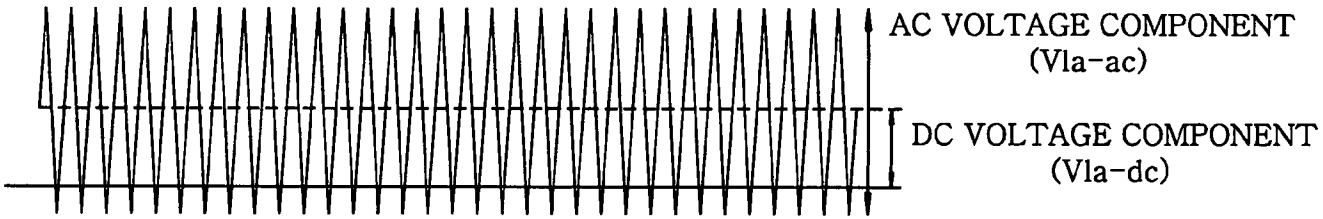
Figure 3C:
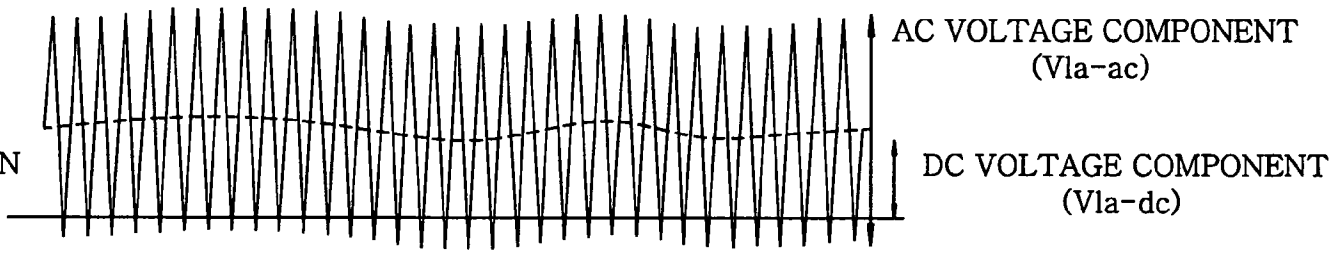

FIGS. 3A to 3C illustrate waveforms of an AC voltage component and a DC voltage component of a voltage applied between two terminals of the discharge lamp La during the low light flux lighting condition in the preferred embodiment. FIG. 3A shows a waveform diagram of a voltage during an ordinary lighting condition; FIG. 3B, at a low temperature; and FIG. 3C, under a flickering condition. As shown in FIG. 3A, during the ordinary lighting condition, the DC voltage component is superposed on the high frequency AC voltage component supplied from the high frequency power supply 1. However, if the ambient temperature of the discharge lamp La is lowered, the vapor pressure of the mercury in the discharge lamp La decreases, and thus the impedance of the discharge lamp La is raised, which results in the DC voltage component increased as illustrated in FIG. 3B. At the same time, a light flux of the discharge lamp La is reduced, and the discharge becomes unstable, leading to the flickering or the extinguishment of the light. As shown in FIG. 3C, the impedance of the discharge lamp La varies irregularly during the flickering condition and the DC voltage component also varies accordingly.

For this reason, if the DC voltage component has increased, it is assumed that the light flux of the discharge lamp La has been reduced, and therefore it is preferable to increase the power supplied to the discharge lamp La. On the contrary, if the detected value has decreased, it is assumed that the light flux of the discharge lamp La has been raised, and therefore it is beneficial to decrease the power supplied to the discharge lamp La. By this correction, the flickering or the extinguishment of the light can be prevented. The flickering in FIG. 3C can also be suppressed by making a correction to an output to the discharge lamp La in accordance with the variation of the DC voltage component.

Figure 4:
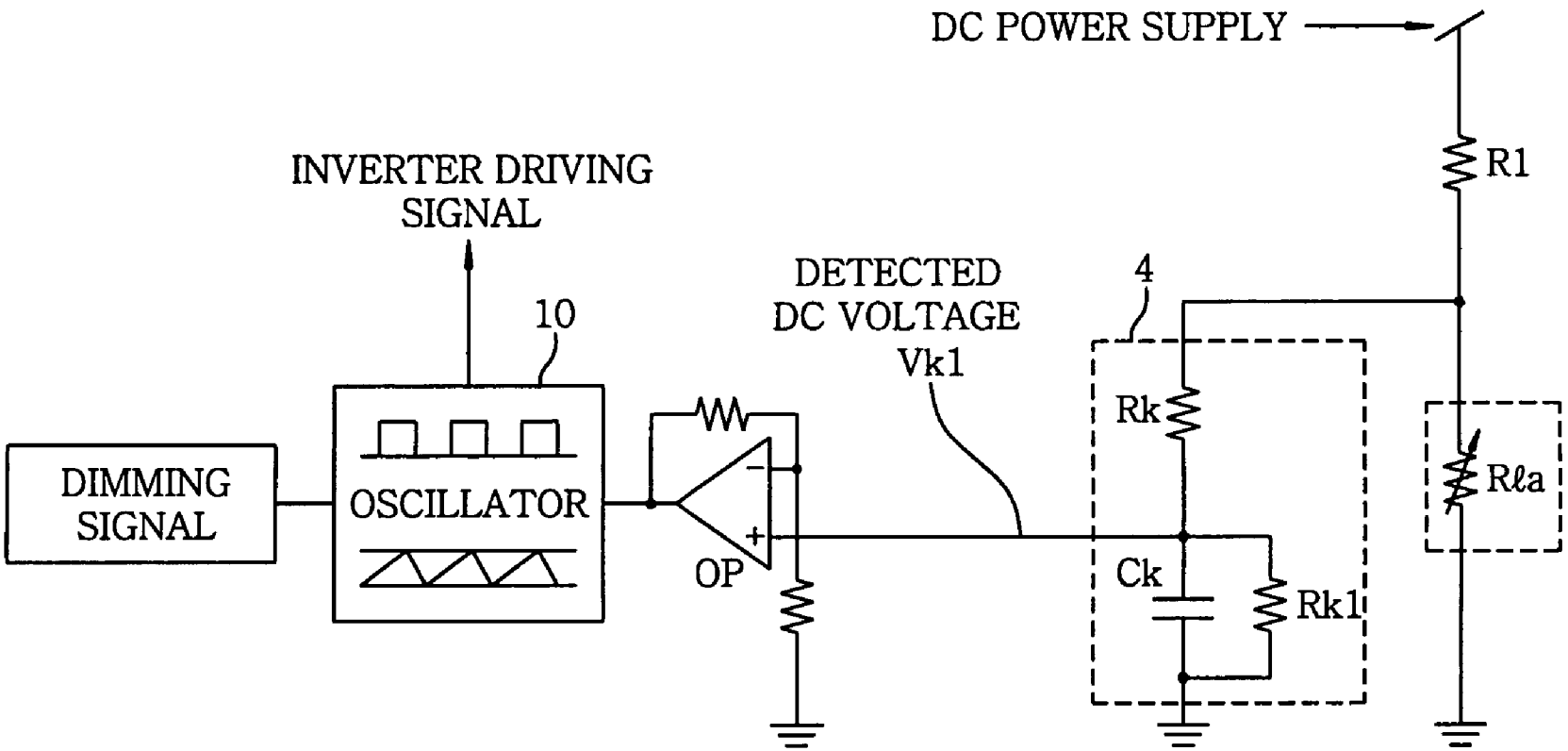
FIG. 4 illustrates a configuration of a DC voltage detection circuit 4, an output correction unit 5, and a dimming control circuit 3.

The DC voltage detection circuit 4, the output correction unit 5, and the dimming control circuit 3 can be configured as illustrated in FIG. 4. Therein, the discharge lamp La is represented for the sake of convenience as a variable resistor R1*a* varying according to the illumination ratio or the ambient temperature. The DC voltage detection circuit 4 includes a circuit wherein a resistor Rk is connected in series to a parallel circuit of a resistor Rk1 and a capacitor Ck. The DC voltage detection circuit 4 is connected in parallel to the variable resistor Rla. And connected to the connection node between the resistor Rk and the capacitor Ck is an operational amplifier OP that amplifies the value detected by the DC voltage detection circuit 4. An output terminal of the operational amplifier OP is connected to an oscillator 10. The operational amplifier OP and the oscillator 10 correspond to the output correction unit 5 and the dimming control circuit 3.

In this configuration, the DC voltage detection circuit 4 divides the DC voltage component developed on the variable resistor Rla into potentials on the resistor Rk and the resistor Rk1, and detects a voltage Vk1 between two terminals of the resistor Rk1. The detected voltage is appropriately amplified by the operational amplifier OP, and is inputted to the oscillator 10. The oscillator 10 decreases a frequency of an inverter driving signal when the output voltage of the operational amplifier OP has increased, and increases the frequency of the inverter driving signal when the output voltage of the operational amplifier OP has decreased.

Figure 5:
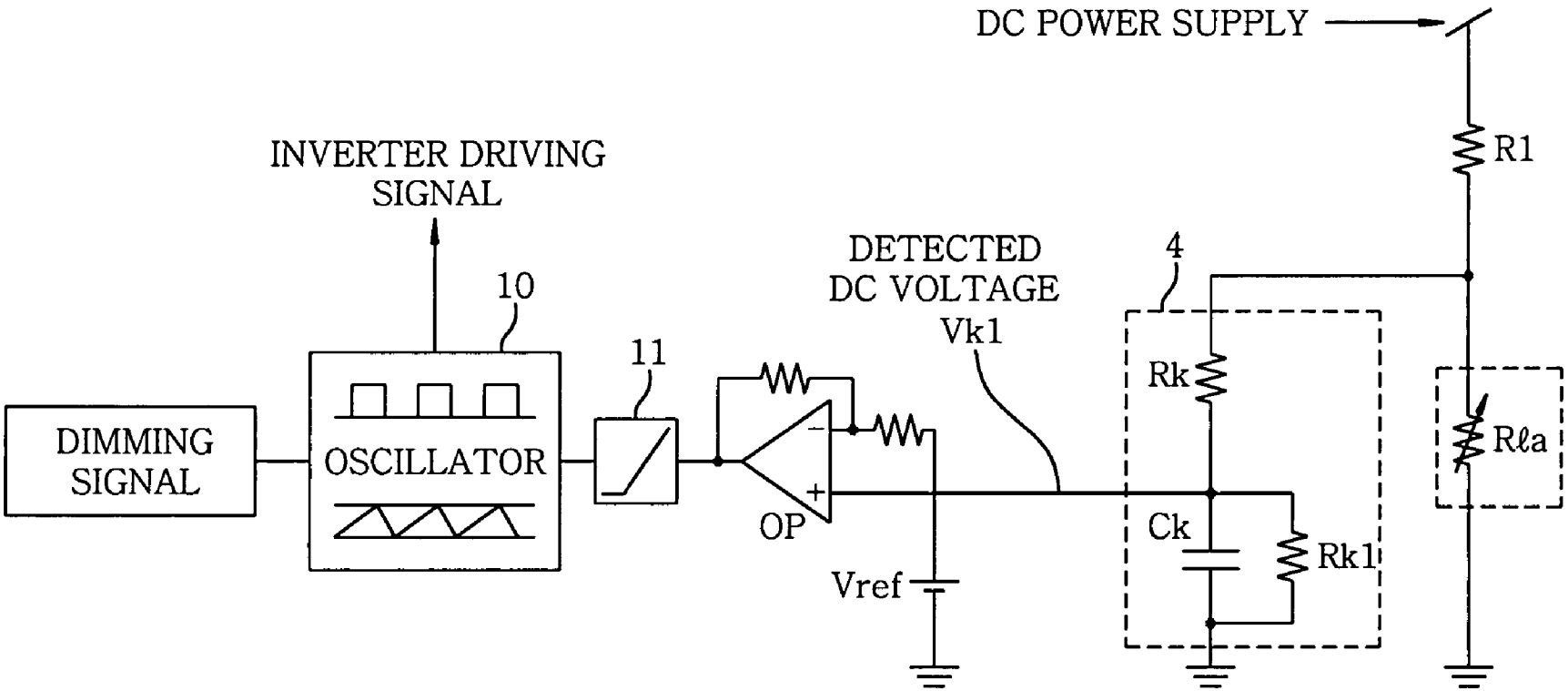
FIG. 5 offers another configuration of the DC voltage detection circuit 4, the output correction unit 5, and the dimming control circuit 3.

The DC voltage detection circuit 4, the output correction unit 5, and the dimming control circuit 3 can also be configured as illustrated in FIG. 5. In comparison with the configuration given in FIG. 4, that of FIG. 5 is distinguished in that a reference voltage Vref is applied to an inverting input terminal of the operational amplifier OP, and a lower bound limiting circuit 11 for the output voltage is provided at the output terminal of the operational amplifier OP.

Figure 6A:
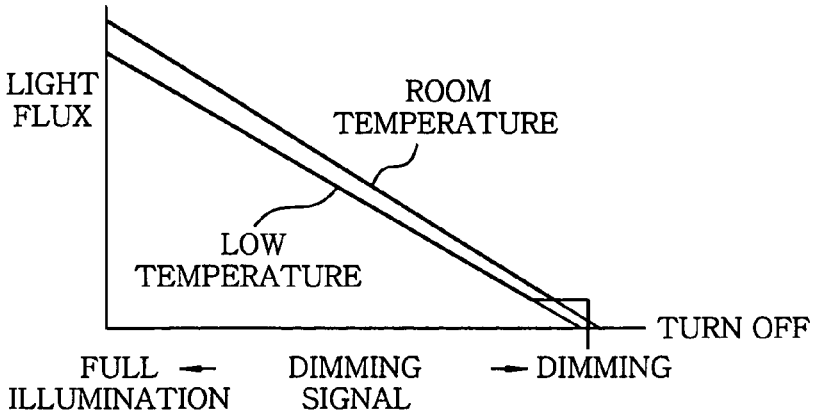
FIG. 6A represents a relationship between a dimming signal and a light flux of a discharge lamp.
Figure 6B:
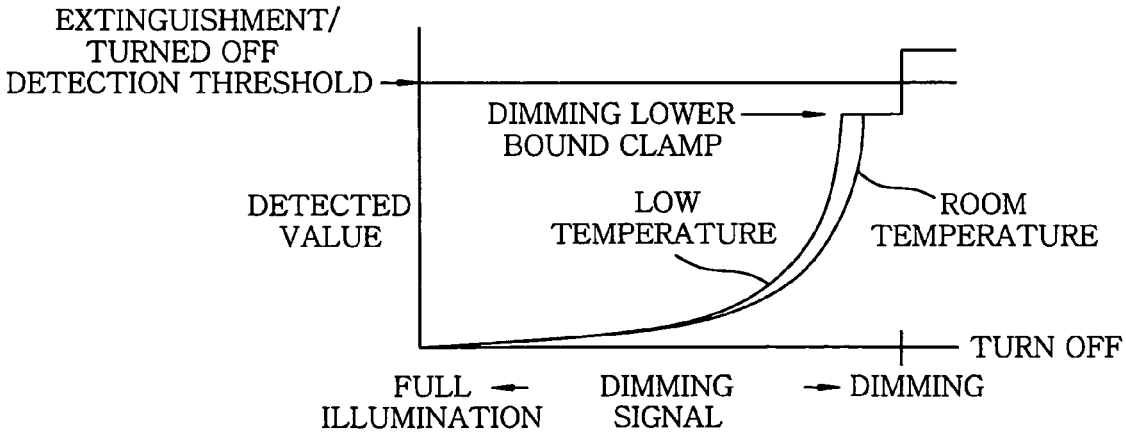
FIG. 6B depicts a relationship between a dimming signal and a value detected by the DC voltage detection circuit.

In the configuration above, the value detected by the DC voltage detection circuit 4 can be controlled to be generally fixed at a value determined by the reference voltage connected to the inverting input terminal of the operational amplifier OP. And, as illustrated in FIG. 6A, the light flux of the discharge lamp La can be controlled to remain above a predetermined value in the vicinity of the lower bound of the dimming condition. As illustrated in FIG. 6B, when the discharge lamp La is turned off by an input of turn-off signal, the impedance of the discharge lamp La grows infinite, and is divided on the resistors R1, Rk and Rk1. For this reason, when the detected value exceeds a predetermined value, it can be assumed that the discharge lamp La has been turned off or has not been lit up, and therefore application of a driving signal to the switch elements Q2 and Q3 may be stopped.

Figure 7:
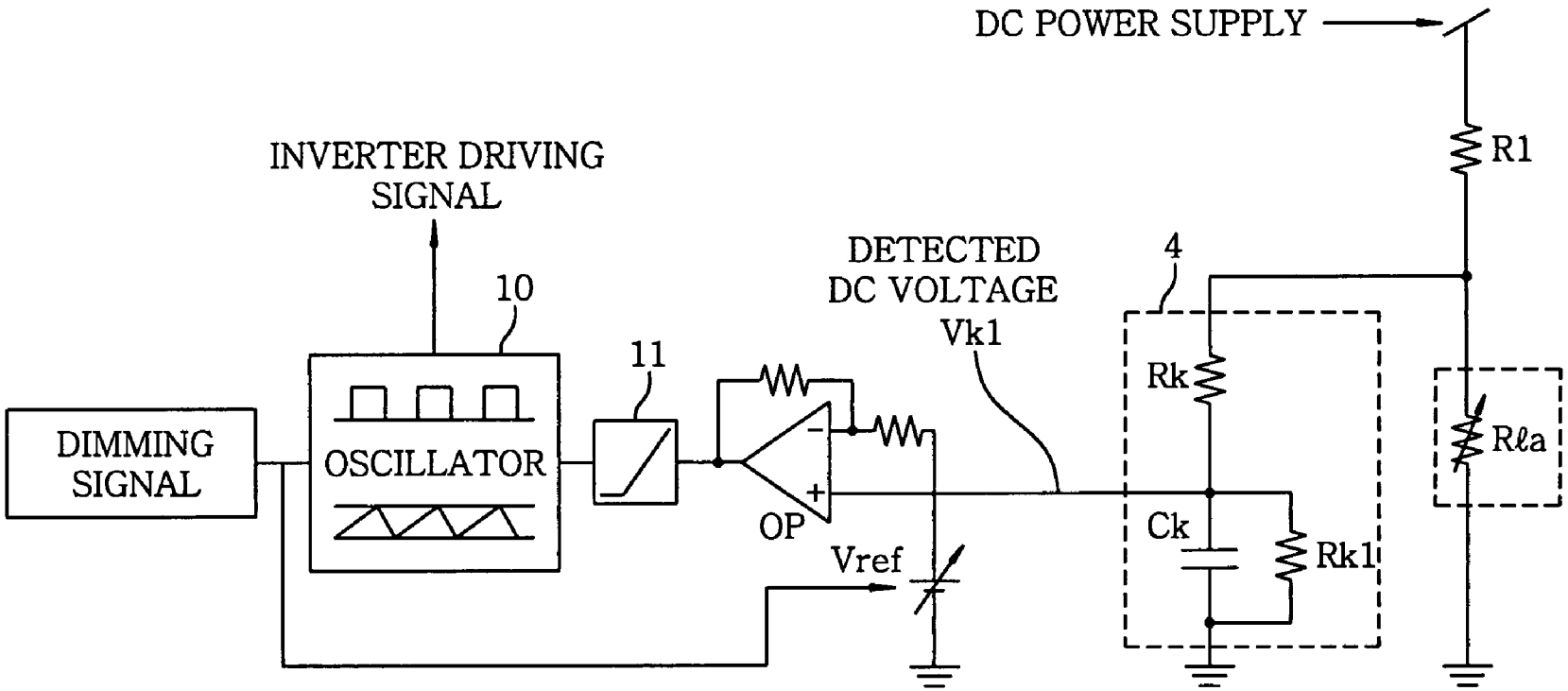
FIG. 7 presents still another configuration of the DC voltage detection circuit 4, the output correction unit 5, and the dimming control circuit 3.

And further, the DC voltage detection circuit 4, the output correction unit 5, and the dimming control circuit 3 can be also configured as illustrated in FIG. 7. In the configuration of FIG. 7, an input terminal of the oscillator 10 corresponding to the dimming control circuit 3 is connected to the reference power source Vref of the operational amplifier OP, and the reference voltage from the reference power source Vref varies in accordance with the dimming signal. As a consequence, the detected value, i.e., the impedance of the discharge lamp La, can be controlled in harmony with the dimming signal while the dimming approaches to the lower bound thereof. A wide range of correction in the light output can be accomplished.

Besides, although a dimming of the discharge lamp La is controlled by controlling a frequency of the driving signal outputted from the inverter driving circuit 9 in the preferred embodiment, the dimming can be controlled also by controlling a duty ratio of the driving signal.

Figure 8:
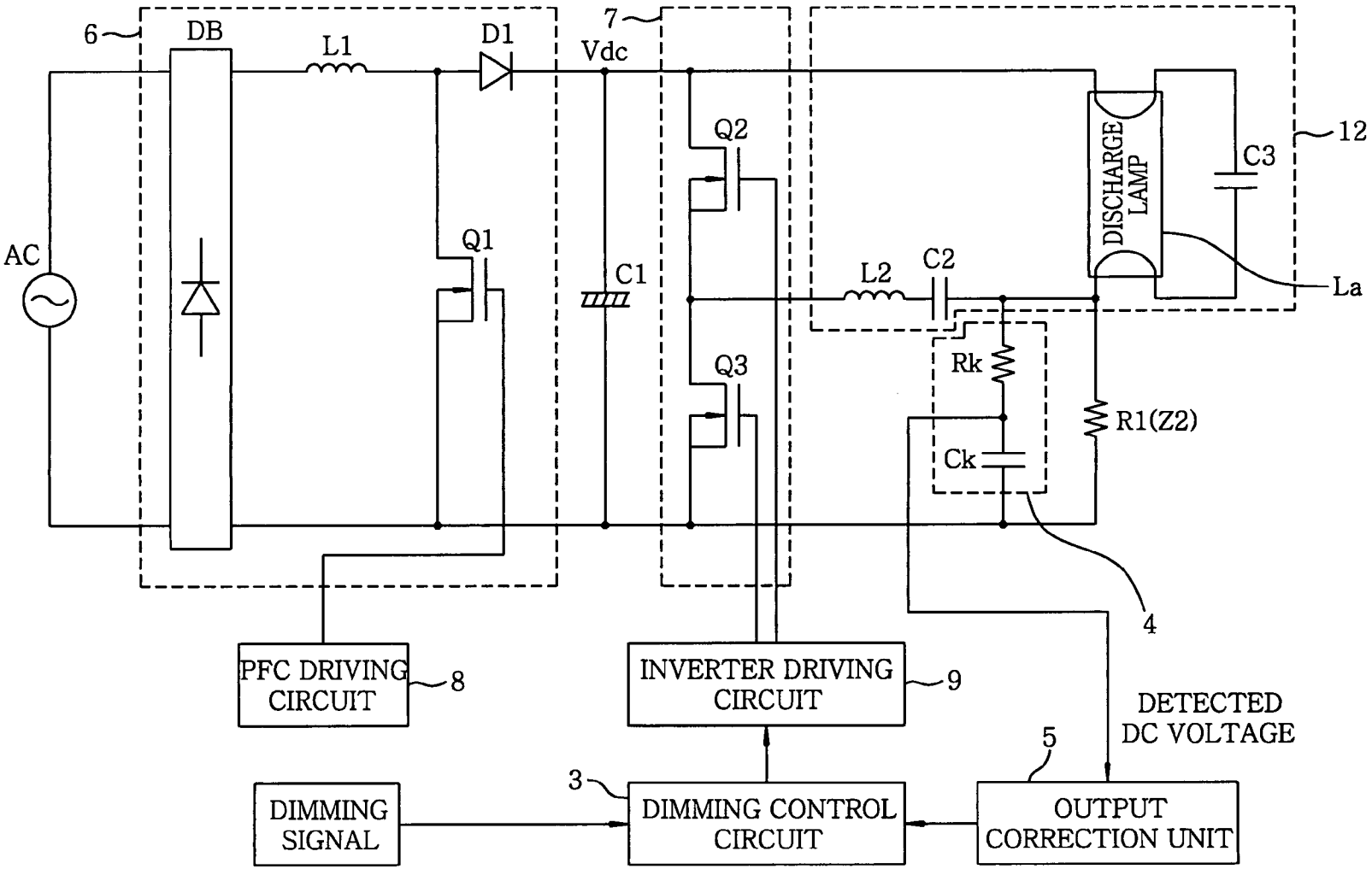
FIG. 8 shows a circuit diagram in accordance with a second preferred embodiment of the present invention.

A second preferred embodiment in accordance with the present invention will now be explained with reference to FIG. 8, shows a detailed circuit diagram thereof.

The second preferred embodiment is identical to the first preferred embodiment, excepting that the resistor R1 functioning as the second impedance element Z2 is connected in parallel to the DC voltage detection circuit 4 which is the series circuit of the resistor Rk and the capacitor Ck; and the parallel circuit of the discharge lamp La and the capacitor C3 is connected between the anode of the diode D1 and the capacitor C2.

In the above configuration, if the impedance of the discharge lamp La increases, a voltage between two terminals of the resistor R1 is reduced. And therefore, if the impedance of the discharge lamp La increases, the voltage between two terminals of the capacitor Ck is also reduced.

Thus, if the value detected by the DC voltage detection circuit 4 has increased, it is assumed that a light flux of the discharge lamp La has been raised, and therefore a frequency of a driving signal from an inverter driving circuit 9 is driven to increase, so that the power supplied to the discharge lamp La is decreased. On the contrary, if the value detected by the DC voltage detection circuit 4 has decreased, it is assumed that the light flux of the discharge lamp La has been reduced, and therefore the frequency of the driving signal from the inverter driving circuit 9 is driven to decrease to increase the power supplied to the discharge lamp La.

Also in the above configuration, when the impedance of the discharge lamp La varies due to, e.g., a variation in the ambient temperature during the dimming control, a flickering or an extinguishment of the light can be suppressed to thereby light the discharge lamp La stably by controlling a power supplied to the discharge lamp La in accordance with an indirectly detected DC component of the voltage applied to the discharge lamp La.

Figure 9:
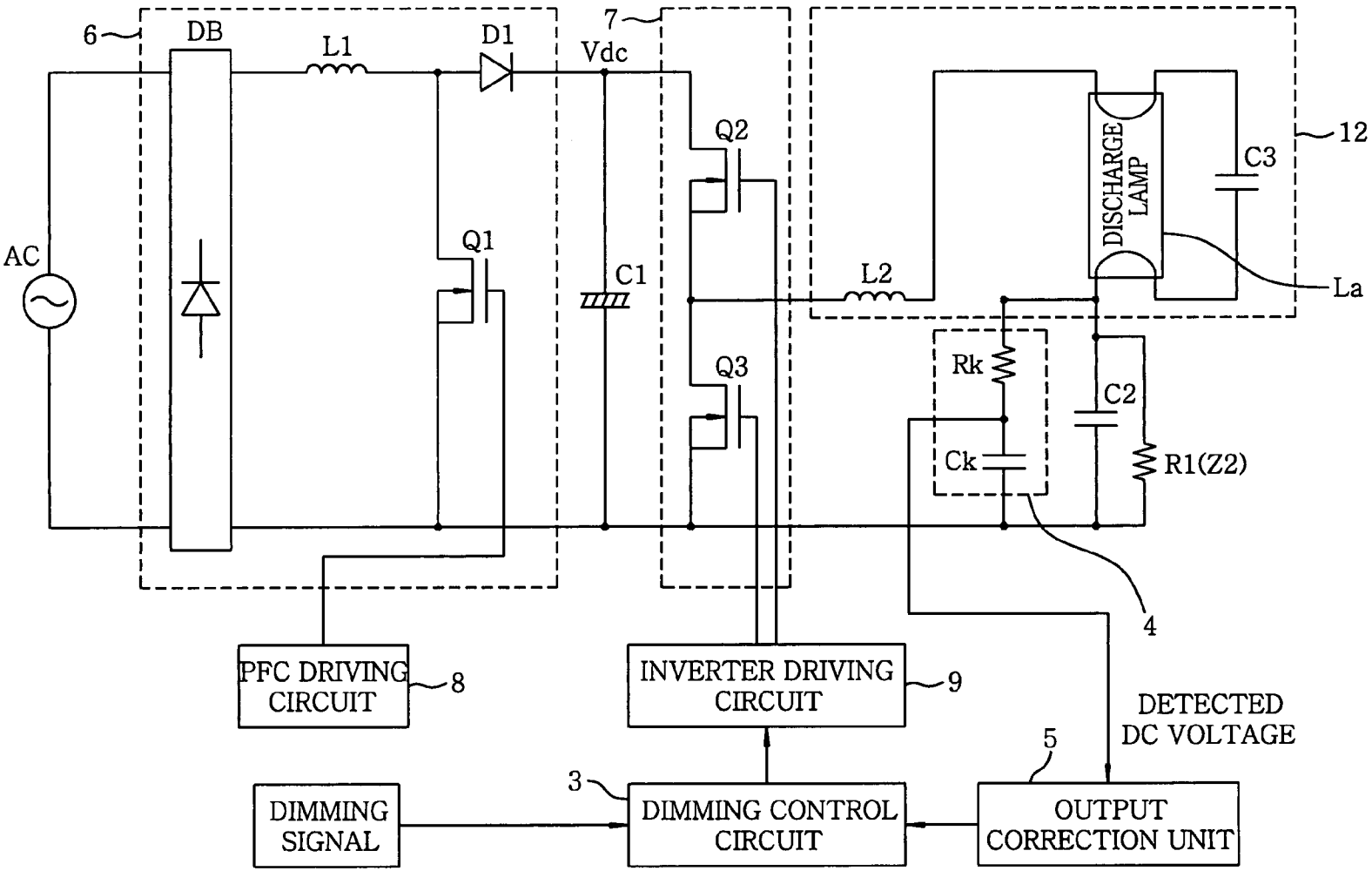
FIG. 9 describes a circuit diagram in accordance with a third preferred embodiment of the present invention.

A third preferred embodiment of the present invention is presented with reference to FIG. 9 showing a detailed circuit diagram thereof.

The third preferred embodiment is identical to the second preferred embodiment, excepting that the capacitor C2 is connected to two terminals of a resistor R1, and one terminal of the discharge lamp La is connected to the inductor L2.

In the above configuration, a high frequency square wave voltage to which a DC voltage is superposed is applied to the discharge lamp La via the inductor L2 and the resistor R1 that have low impedance against a DC component.

In the above configuration, if the impedance of the discharge lamp La increases, a voltage between two terminals of the resistor R1 is reduced. And therefore, in contrast to the first preferred embodiment, if the impedance of the discharge lamp La increases, the voltage between two terminals of the capacitor Ck is reduced.

For this reason, in the same way as the second preferred embodiment, when the impedance of the discharge lamp La varies due to, e.g., a variation in the ambient temperature during the dimming control, a flickering or an extinguishment of the light can be suppressed to thereby light the discharge lamp La stably, by controlling a power supplied to the discharge lamp La in accordance with an indirectly detected DC component of voltage applied to the discharge lamp La.

Figure 10:
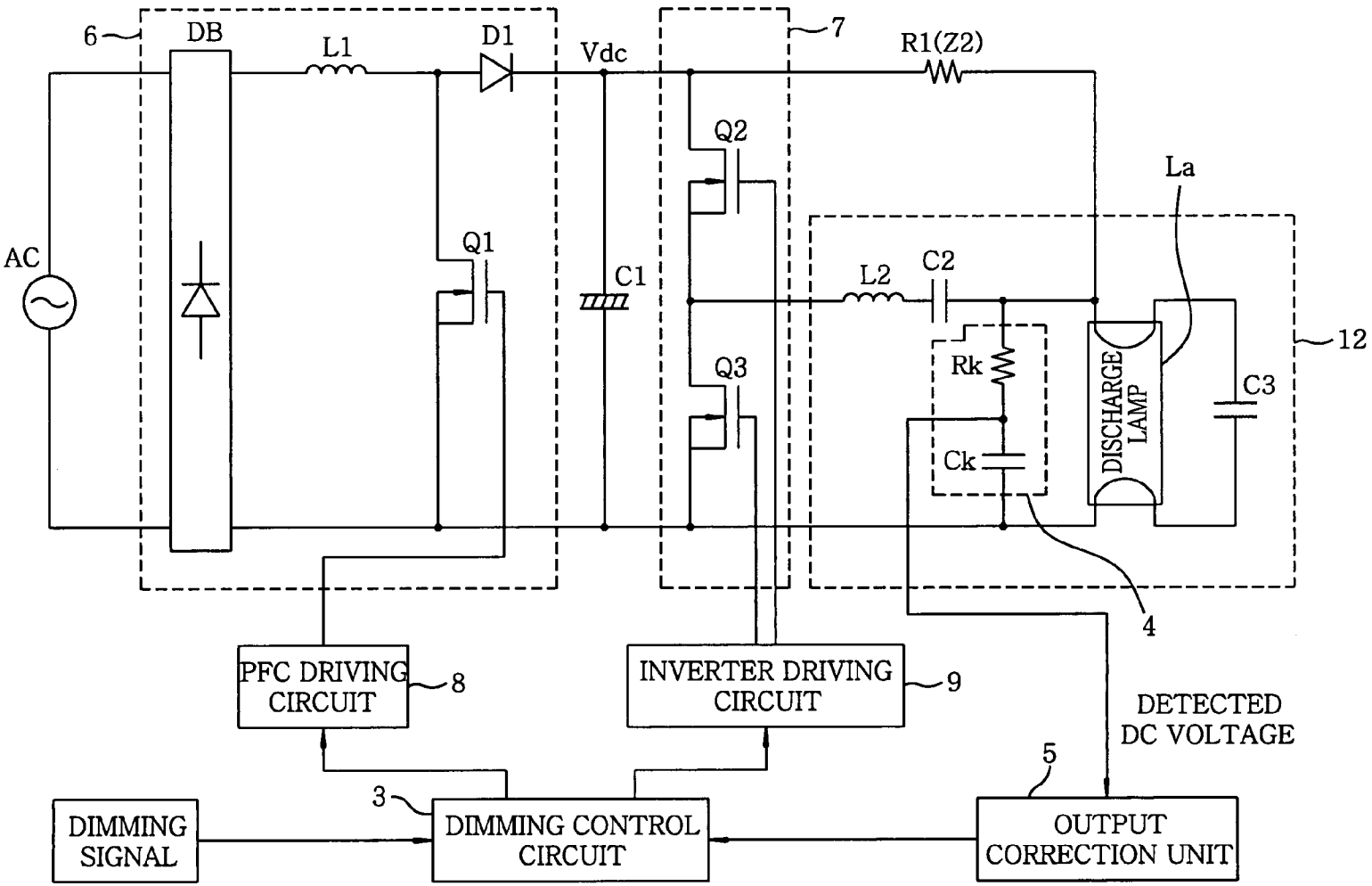
FIG. 10 offers a circuit diagram in accordance with a fourth preferred embodiment of the present invention.

A fourth preferred embodiment of the present invention is presented with reference to FIG. 10 showing a detailed circuit diagram thereof.

The fourth preferred embodiment is identical to the first preferred embodiment, excepting that the PFC driving circuit 8 which outputs the driving signal for the switch element Q1 is connected to the dimming control circuit 3.

In this configuration, the dimming control circuit 3 receives a value detected by the DC voltage detection circuit 4 via the output correction unit 5. In accordance with the received valueto control the PFC driving circuit 8 and the inverter driving circuit 9. In this way, the DC voltage of a smoothing capacitor C1 and the driving frequency of the switch elements Q2 and Q3 are controlled, so that a power supplied to the discharge lamp La is controlled.

Thus, the output of the discharge lamp La can be corrected. More specifically, the lighting of the discharge lamp La can be maintained by increasing a DC power supplied to the discharge lamp La when the discharge lamp La is apt to be extinguished due to a low ambient temperature.

Figure 11:
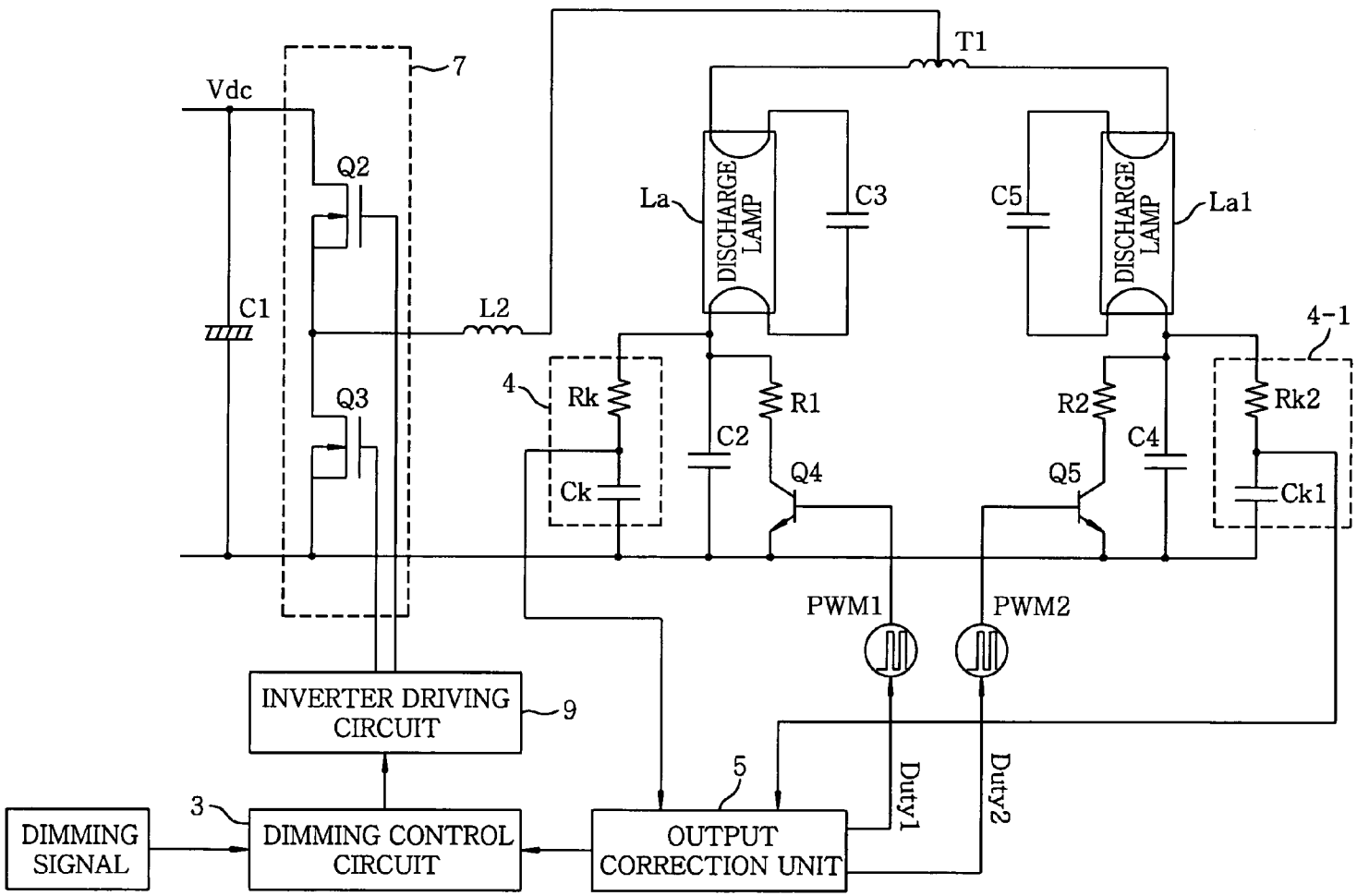
FIG. 11 provides a circuit diagram in accordance with a fifth preferred embodiment of the present invention.
Figure 12:
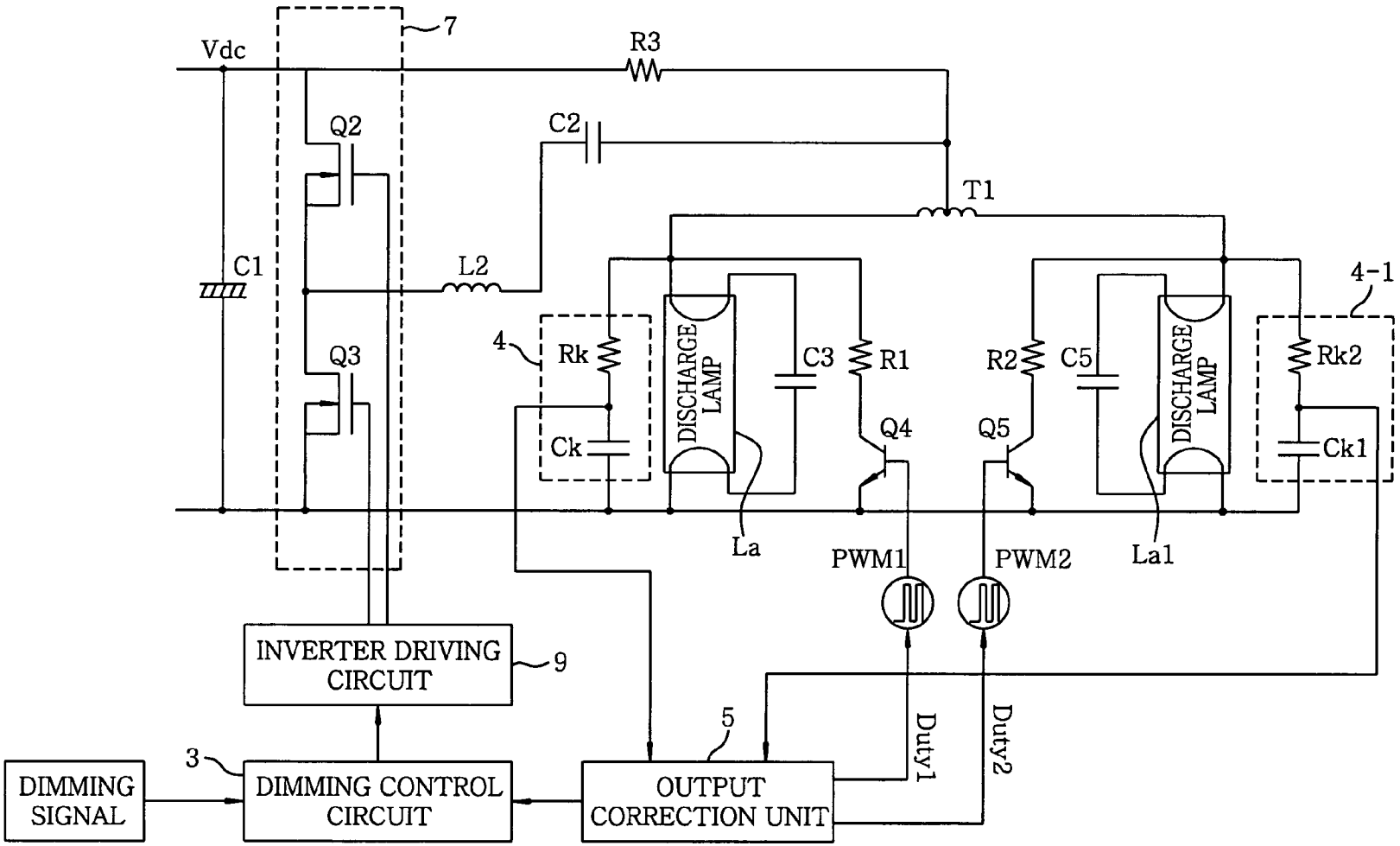
FIG. 12 presents another circuit diagram of the fifth preferred embodiment.

A fifth preferred embodiment of the present invention will now be described with reference to FIGS. 11 and 12. FIG. 11 illustrates a detailed circuit diagram of the preferred embodiment; and FIG. 12 shows another detailed circuit diagram thereof.

The fifth preferred embodiment differs from the third preferred embodiment in following features. A switch element Q4 is connected to the resistor R1 serving to superpose a DC voltage. And further, connected in parallel between the inductor L2 and the lower potential side of the smoothing capacitor C1 are a first circuit, which includes the discharge lamp La, the capacitor C3, the resistor Rk, the capacitor Ck, the capacitor C2, the resistor R1, and the switch element Q4, and a second circuit, which has the same configuration as the first circuit to include a discharge lamp La1, a capacitor C5, a resistor Rk2, a capacitor Ck1, a capacitor C4, a resistor R2, and a switch element Q5. And, the discharge lamps La and La1 are connected to the inductor L2 via a transformer T1 that works as a balancer. Furthermore, the output correction unit 5 is connected to the switching elements Q4 and Q5, and is also connected to a connection node between the resistor Rk2 and the capacitor Ck1 and that between the resistor Rk and the capacitor Ck.

In the above configuration, the output correction unit 5 outputs pulse width modulation (PWM) signals for the switching elements Q4 and Q5 in accordance with the detected DC voltages of the discharge lamps La and La1. In this way, the output correction unit 5 controls an output to the discharge lamp by controlling an impedance value of the second impedance element.

Therefore, even in a case of illumination control of plural discharge lamps, e.g., La and La1, it is possible to compensate for the differences in light fluxes of the discharge lamps La and La1 due to incongruities in characteristics of circuit components.

Moreover, while the DC voltage detection circuit 4 is prepared in series to each of the discharge lamps La and La1 in the above configuration, an alternative configuration is also possible as shown in FIG. 12. In the configuration in FIG. 12, a resistor R3 is connected between the transformer T1 and a higher potential side of the capacitor C1, and the capacitor C2 is interposed between the transformer T1 and the inductor L2. Also, the DC voltage detection circuit 4 and the series circuit of the resistor R1 and the switch element Q4 are prepared in parallel to the discharge lamps La; and similarly, a DC voltage detection circuit 4-1 and the series circuit of the resistor R2 the switch element Q5 are disposed in parallel to the discharge lamp La1, while the capacitor C4 is removed in FIG. 12 configuration. The configuration also can control a DC voltage superposed on the discharge lamps La and La1. And therefore, even in a case of illumination control of a plurality of discharge lamps, e.g., La and La1, is also possible to compensate for differences in light fluxes of the discharge lamps La and La1 due to variations in characteristics of circuit components.

Figure 13:
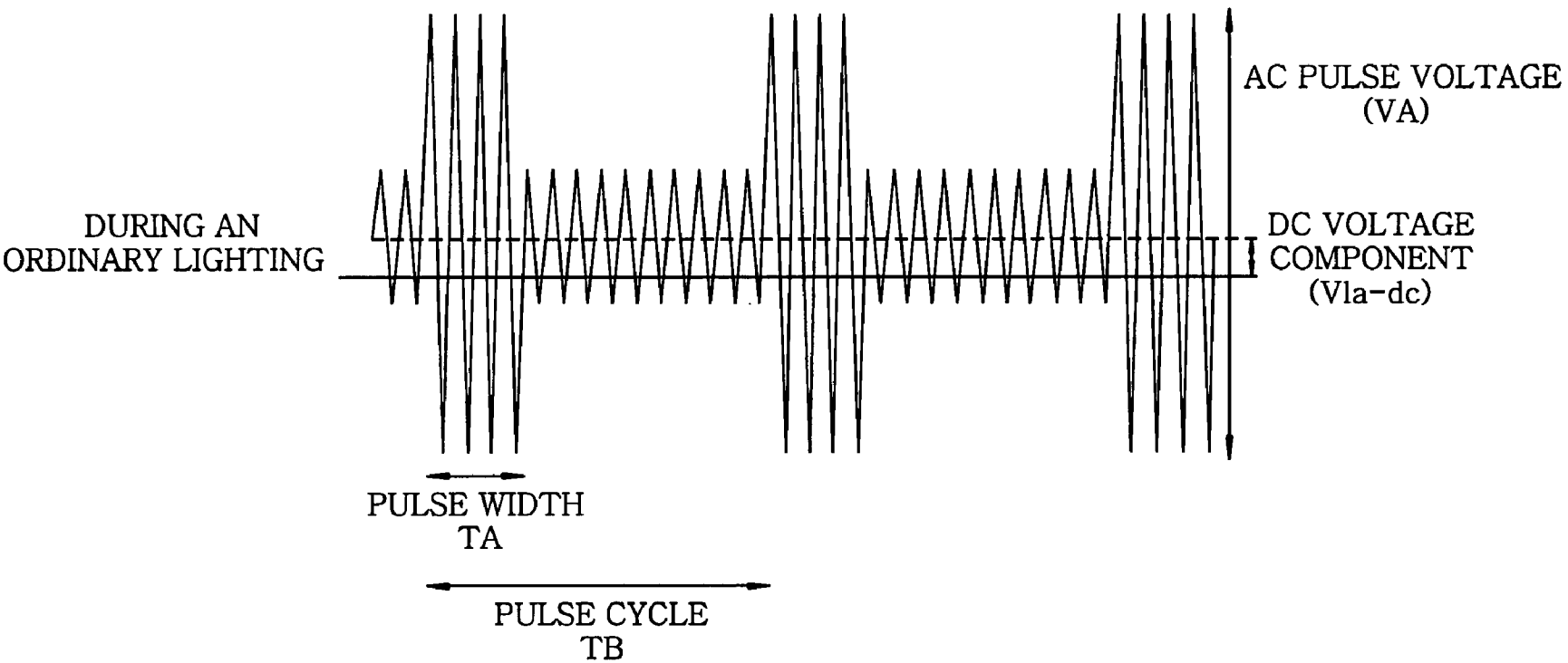
FIG. 13 illustrates a waveform diagram of voltage on which an AC pulse voltage is superposed.

In the preferred embodiments described above, a pulse generation circuit (not shown) may be provided, which enables to further superpose, in addition to the DC voltage component, an AC pulse voltage on the high frequency voltage during the low light flux lighting control of the discharge lamp as shown in FIG. 13.

In this case, the output of the discharge lamp can be corrected by controlling the pulse width, the pulse period, and/or the pulse peak of the AC pulse voltage in accordance with the detected value of the DC voltage component.

In the above configuration, even in a case where the ambient temperature is lowered and thus the discharge lamp La is in a state liable to be extinguished, lighting of the discharge lamp La can be maintained and an output of the discharge lamp La can be corrected by controlling the pulse width, the pulse period and/or the pulse peak of the AC pulse voltage.

Figure 14:
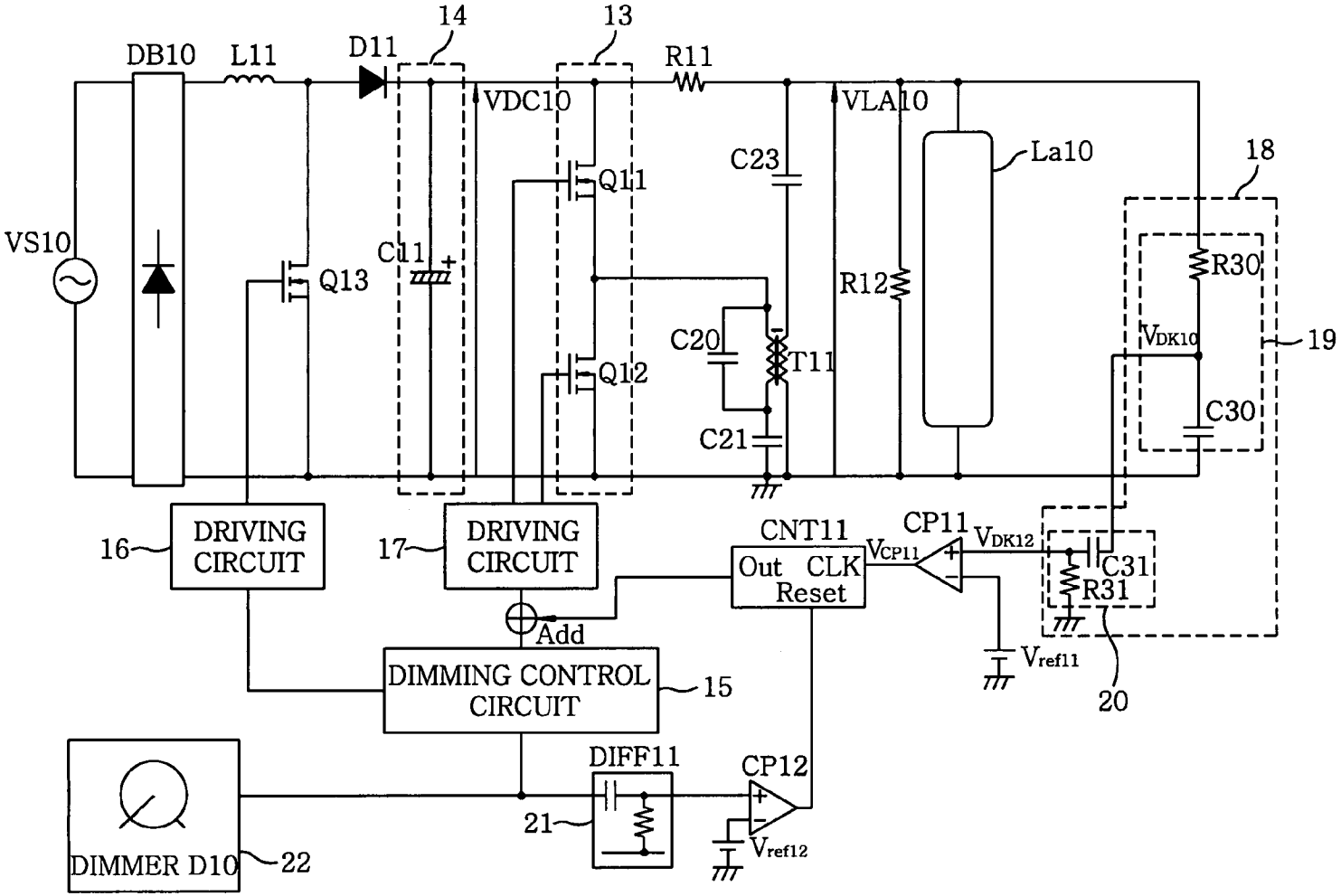
FIG. 14 shows a circuit diagram in accordance with a sixth preferred embodiment of the present invention.

Hereinafter, a sixth preferred embodiment of the present invention will be described with reference to FIGS. 14 to 17. FIG. 14 is a detailed circuit diagram of the present embodiment.

A discharge lamp lighting device of the current preferred embodiment includes an inverter circuit 13 for supplying a high frequency power to a discharge lamp La10, a DC power supply 14 for supplying a DC power to the discharge lamp La10 through a resistor R11 which acts as an impedance element, and a dimming control circuit 15 for dimming a discharge lamp La10 by controlling an AC power from the inverter circuit 13.

In detail, as shown in FIG. 14, connected to the commercial power source VS10 is a diode bridge DB10 and a switch element Q13 is connected to an output terminal of the diode bridge DB10 via an inductor L11. Connected to the switch element Q13 via a diode D11 is a capacitor C11 corresponding to a DC power supply 14. Connected to an output terminal of the capacitor C11 is a series circuit of switch elements Q11 and Q12, which corresponds to the inverter circuit 13. A series circuit of a primary winding of a leakage transformer T11 and a capacitor C21 is connected to two terminals of the switch element Q12. Connected in parallel to the primary winding of the leakage transformer T11 is a capacitor C20. A series circuit of a capacitor C23 and a secondary winding of the leakage transformer T11 is connected to the series circuit of the switch elements Q11 and Q12 via the resistor R11. Connected to output terminals of the capacitor C11 is a series circuit of resistors R11 and R12 and connected in parallel to two terminals of the resistor R12 are a discharge lamp La10 which is a fluorescence lamp and a series circuit of a resistor R30 and a capacitor C30.

The dimming control circuit 15 is connected to the switch element Q13 via a driving circuit 16, and also is connected to the switch elementes Q11 and Q12 via a driving circuit 17.

Figure 17:
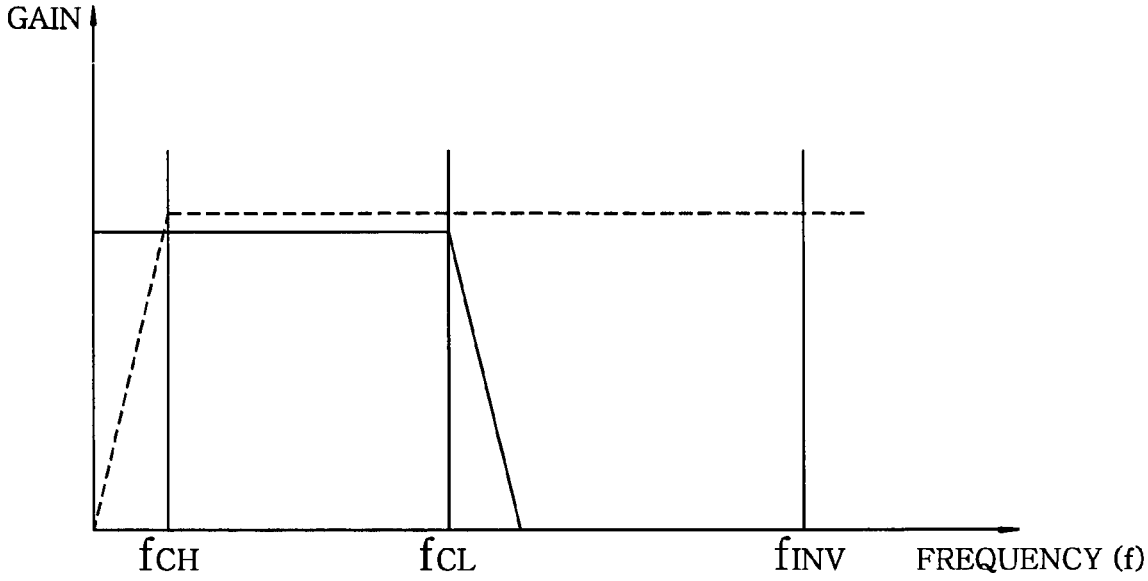
FIG. 17 represents a relationship between a frequency and a gain in the sixth preferred embodiment.

In order to detect a fluctuation of a DC component of a voltage applied to the discharge lamp La10, there is provided a fluctuation voltage detection circuit 18 composed of a low pass filter 19 and a high pass filter 20. The low pass filter 19, being a series circuit of the resistor R30 and the capacitor C30, is connected to two terminals of the discharge lamp; and the high pass filter 20 including a capacitor C31 and a resistor R31 is connected to a connection node between the resistor R30 and the capacitor C30. As shown in FIG. 17 with a solid line, the low pass filter 19 is configured to pass therethrough a fluctuation of the DC voltage component of a frequency equal to or lower than fCL(100 Hz), which is lower than an operating frequency fINV of the inverter. Also as shown in FIG. 17 with a dashed line, the high pass filter 20 is configured to pass a fluctuation of the DC voltage component of a frequency equal to or higher than fCH(1 Hz).

The connection node between the capacitor C31 and the resistor R31 is connected to a non-inverting input terminal (+) of a comparator CP11, while connected to an inverting input terminal (−) thereof is a DC power source Vref11. And, connected to an ouptut terminal of the comparator CP11 is a counter CNT11 whose output terminal is connected to an adder Add between the dimming control circuit 15 and the driving circuit 17. Connected to a reset terminal of the counter CNT11 is an output terminal of a comparator CP12. A (+) input terminal of the comparator CP12 is connected to a dimmer 22 via a differentiator 21. And a (−) input terminal thereof is connected to a DC power source Vref12. The dimmer 22 is also connected to the dimming control circuit 15.

In the above configuration, an AC voltage is supplied from the commercial power source VS10 and rectified by the diode bridge DB10. By switching the switch element Q13 according to a driving signal from the driving circuit 16, the inductor L11 accumulates energy, which produces a desired DC voltage at two terminals of the capacitor C11. And then, by switching the switch elements Q11 and Q12 alternately according to a high frequency driving signal from the driving circuit 17, a high frequency AC power is supplied to the discharge lamp La10. And, since the series circuit of the resistors R11 and R12 is connected to the output terminals of the capacitor C11 and the discharge lamp La10 is connected to two terminals of the resistor R12, a DC power is supplied to the discharge lamp La10. Increasing a driving frequency of the driving signal which drives the switch elements Q11 and Q12 raises a leakage impedance of the leakage transformer T11, so that a lamp current of the discharge lamp La10 decreases.

Figure 15A:
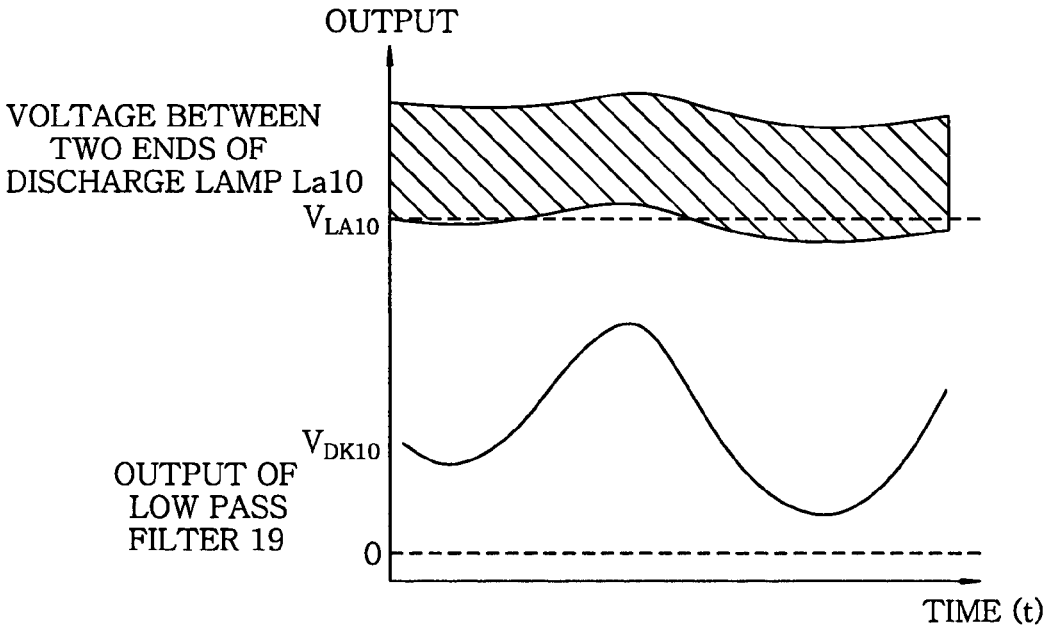
FIG. 15A provides a voltage $V_{LA10}$ between two terminals of the discharge lamp La and an output of a low pass filter 19 in the sixth preferred embodiment.
Figure 15B:
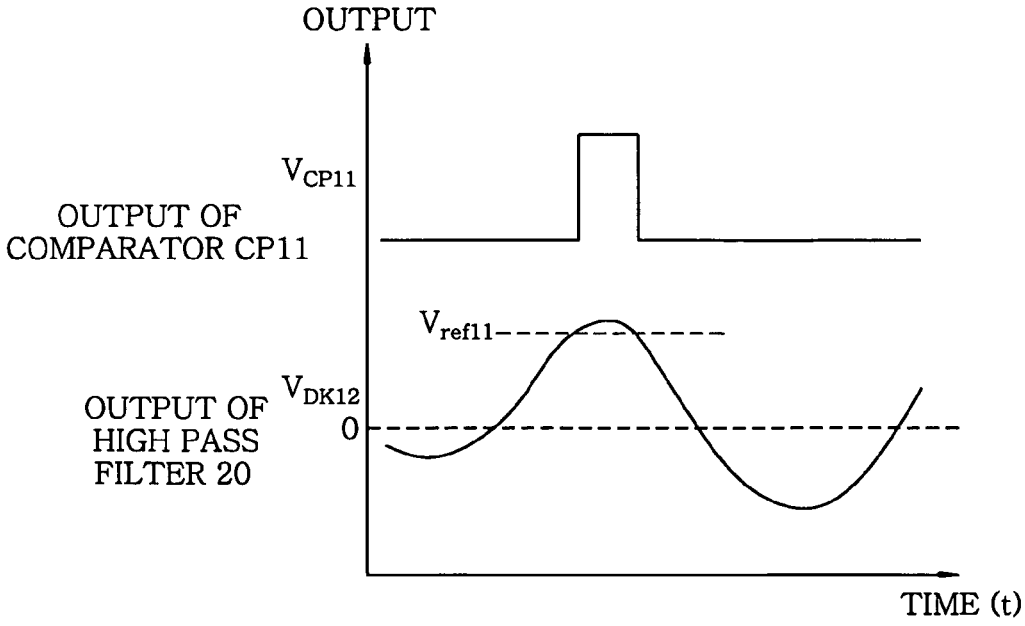
FIG. 15B offers an output of a high pass filter 20 and an output of a comparator CP11 in the sixth preferred embodiment.
Figure 16:
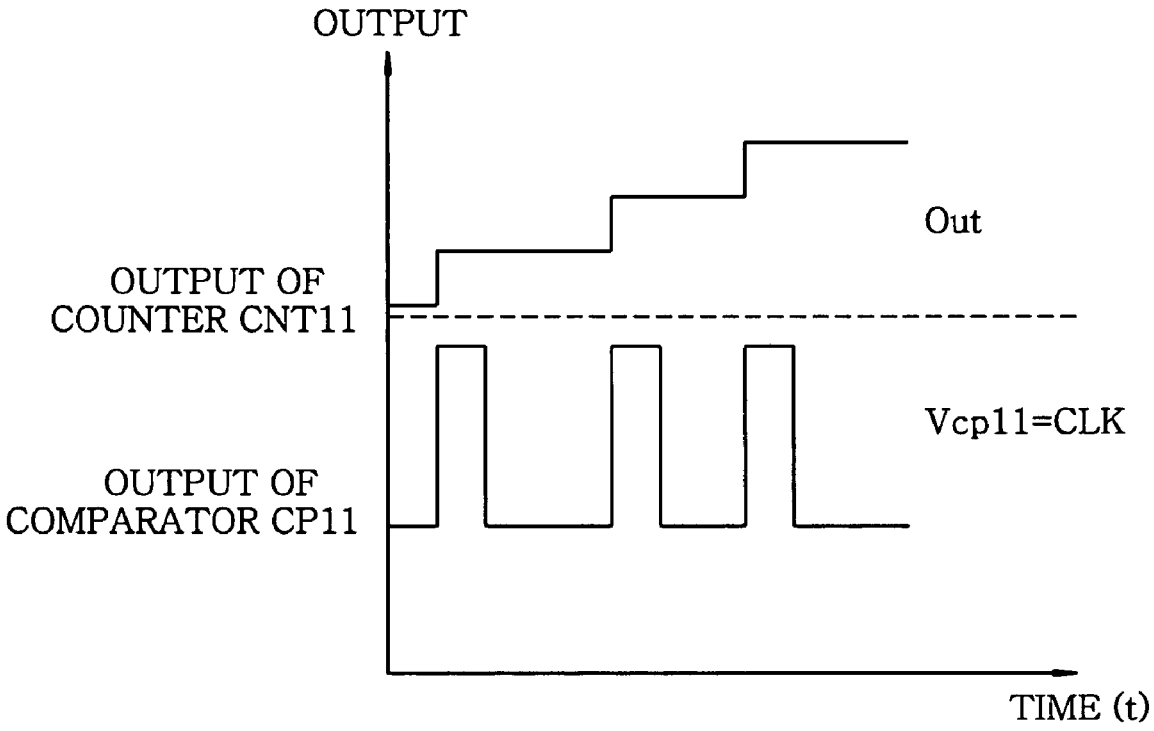
FIG. 16 illustrates an output of the comparator CP11 and that of a counter CNT11 in the sixth preferred embodiment.

As the lamp current decreases, a discharge of the discharge lamp La10 becomes unstable, resulting in a flickering. The unstable discharge implies the unstable impedance of the discharge lamp La10. Therefore, a voltage $V_{LA10}$ between two terminals of the discharge lamp La10 varies as shown in FIG. 15A. The voltage $V_{LA10}$ between two terminals of the discharge lamp La10 is processed in the low pass filter 19, and as a result, an output voltage VDK10 of the low pass filter 19 is a voltage obtained by subtracting high frequency components from the voltage $V_{LA10}$ appearing between two terminals of the discharge lamp La10. And, fluctuation components of the lamp voltage are selected by processing the output voltage VDK10 of the low pass filter 19 with the high pass filter 20. The high pass filter 20 is employed because when the impedance of the discharge lamp La10 varies, the fluctuation of the DC voltage becomes difficult to detect due to a variation of the output voltage VDK10 of the low pass filter caused by a variation of a ratio of divided voltages on the resistor R11, the resistor R12 and the discharge lamp La10. Herein, RC constants of the low pass filter 19 and the high pass filter 20 are set to pass a fluctuation voltage with a frequency of 1 to 100 Hz where flickering can be perceived by the human visual system. The comparator CP11 compares an output voltage VDK12 of the high pass filter 20 with an output voltage of the DC power source Vref11, and outputs, as shown in FIG. 15B, a signal VCP11 to the counter CNT11 if the output voltage VDK12 of the high pass filter 20 is equal to or higher than the output voltage of the DC power source Vref11. As shown in FIG. 16, the counter CNT11 increases a count by 1 if it receives the signal from the comparator CP11. Here, the comparator CP11 may employ a positive amplitude of the output voltage VDK12 of the high pass filter 20, a negative amplitude thereof, or both of the positive amplitude and the negative amplitude thereof for a comparison.

The counter CNT11 outputs a voltage corresponding to the count to the adder Add between the driving circuit 17 and the dimming control circuit 15. Therefore, the frequency of the driving signal from the driving circuit 17 is reduced, and thus, the lamp current of the discharge lamp La10 increases, resulting in a stable discharge thereof. In alternative, the output terminal of the counter CNT11 may be connected to the dimming control circuit 15, to output the voltage corresponding to the count to the dimming control circuit 15.

Further, when a user of the discharge lamp lighting device controls the dimmer 22 to change a dimming level, the differentiator 21 detects a variation of the dimming level, and outputs a signal to the reset terminal of the counter CNT11 to reset the count thereof.

As described above, the preferred embodiment can suppress a flickering of the discharge lamp La10 even when the discharge lamp La10 is used within a positive domain of a current-voltage characteristic, since the fluctuation of the DC voltage component applied to the discharge lamp La10 is detected, and the input power to the discharge lamp La10 is increased according to the fluctuation number of the DC voltage component.

Figure 18:
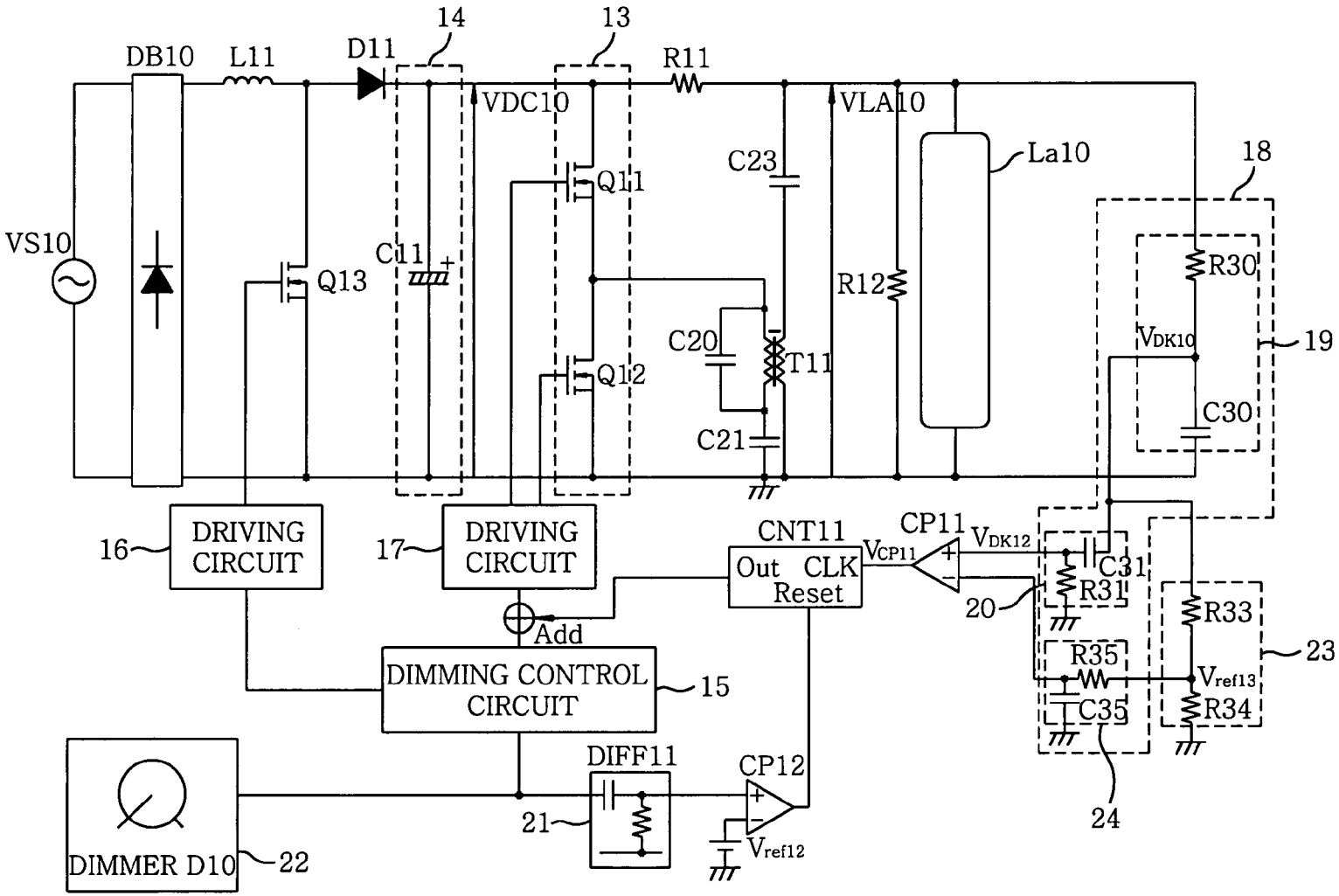
FIG. 18 shows a circuit diagram in accordance with a seventh preferred embodiment of the present invention.

A seventh preferred embodiment of the present invention is explained with reference to FIG. 18 showing a detailed circuit diagram thereof.

The preferred embodiment determines a flickering of a discharge lamp La10 depending on a ripple ratio of a DC voltage component. In comparision with the sixth preferred embodiment, the DC power source Vref11 of the sixth preferred embodiment is replaced with a potential division circuit 23 including resistors R33 and R34, and a low pass filter 24 including a resistor R35 and a capacitor C35. Similar elements to those in the sixth preferred embodiment are designated by similar reference numerals and explanation thereof is omitted.

Connected to a connection node between the capacitors C30 and C31 is a series circuit of the resistors R33 and R34. Further, a connection node between the resistors R33 and R34 is connected to a (−) input terminal of the comparator CP11 via the resistor R35. Connected between the (−) input terminal of the comparator CP11 and the ground is the capacitor CP35, to form the low pass filter 24 together with the resistor R35.

The DC voltage VDK10, applied to the series circuit of the resistor R33 and R34, is divided thereby. And by the low pass filter 24, it becomes a reference voltage being in proportion to a DC voltage component of the discharge lamp La10. An output voltage from the high pass filter 20 is the same as that of the sixth preferred embodiment. Herein, the ripple ratio is controlled by a ratio between the resistors R33 and R34. For example, if the ratio between the resistor R33 and resistor R34 is 1:1, a flickering is detected by the fluctuations of the DC voltage with a ripple ratio of 50%.

As described above, by determining the flickering of the discharge lamp La10 based on the ripple ratio, the filckering can be detected even when the DC voltage component varies due to a change of an output of the dimmer 22 or a flickering of the discharge lamp La10.

In addition, by varing a reference voltage of the comparator CP11 in accordance with a dimming signal, same effects can be achieved.

Figure 19:
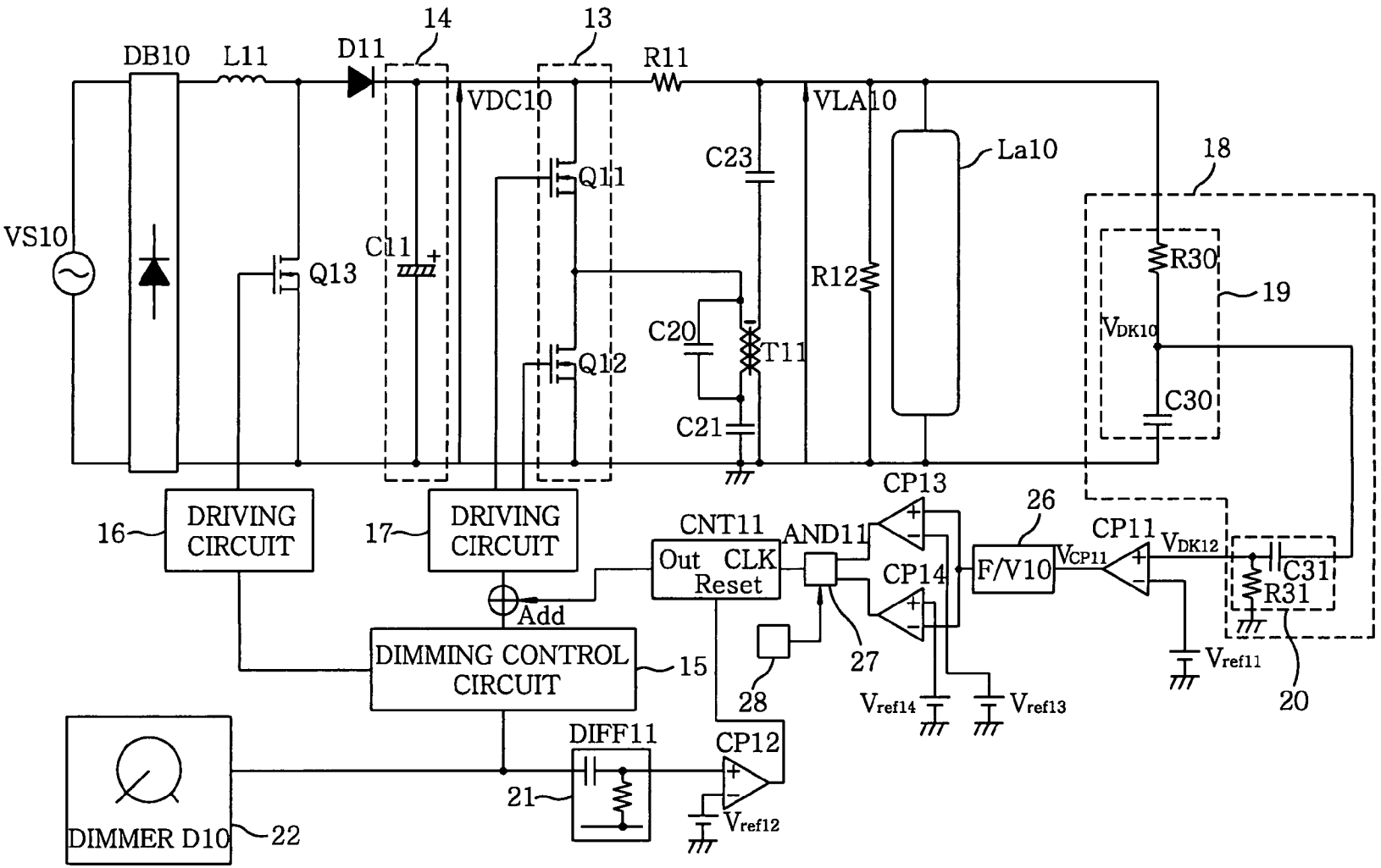
FIG. 19 presents a circuit diagram in accordance with an eighth preferred embodiment of the present invention.

An eighth preferred embodiment of the present invention will now be presented with reference to FIG. 19 showing a detailed circuit diagram thereof.

In the eighth preferred embodiment, a frequency detection circuit, including an F/V (frequency to voltage) converter 26, a comparator CP13 and a comparator CP14, is installed in order to determine a filckering when afluctuation of DC voltage component applied to the discharge lamp La10 is within a specific frequency range.

In detail, connected to an output terminal of the comparator CP11 is the F/V converter 26, and an output terminal of the F/V converter 26 is connected to both of an (+) input terminal of the comparator CP13 and an (−) input terminal of the comparator CP14. Output terminals of the comparator CP13 and the comparator CP14 are connected to input terminals of an AND circuit 27, and an output terminal of the AND circuit 27 is connected to an input terminal of the counter CNT11.

In the above configuration, responsive to a signal detected by the comparator CP11, the F/V converter 26 outputs a voltage corresponding to a frequency of the received signal to the comparators CP13 and CP14. The comparator CP13 receives the output voltage from the F/V converter 26, and when it is equal to or higher than a reference voltage from a DC power source Vref13, the comparator CP13 outputs a signal. Similarly, the comparator CP14 receives the output voltage from the F/V converter 26, and when it is equal to or lower than a reference voltage from a DC power source Vref14, the comparator CP14 outputs a signal. A timer 28 outputs a continuous low frequency Hi/Lo signal. In case when the fluctuation of the DC voltage component of the discharge lamp La10 continues, so that the signals from the comparators CP13 and CP14 are continuosly outputted, the counter CNT11 outputs a voltage corresponding to a count to the adder Add between the dimming control circuit 15 and the driving circuit 17. Thus, the driving circuit 17 increases an AC power to the discharge lamp La10 until the fluctuation frequency goes out of the specific frequency range.

As described above, by detecting the fluctuation of the DC voltage component applied to the discharge lamp La10 by amplitude and frequency thereof, a flickering can be prevented with a higher accuracy.

Figure 20:
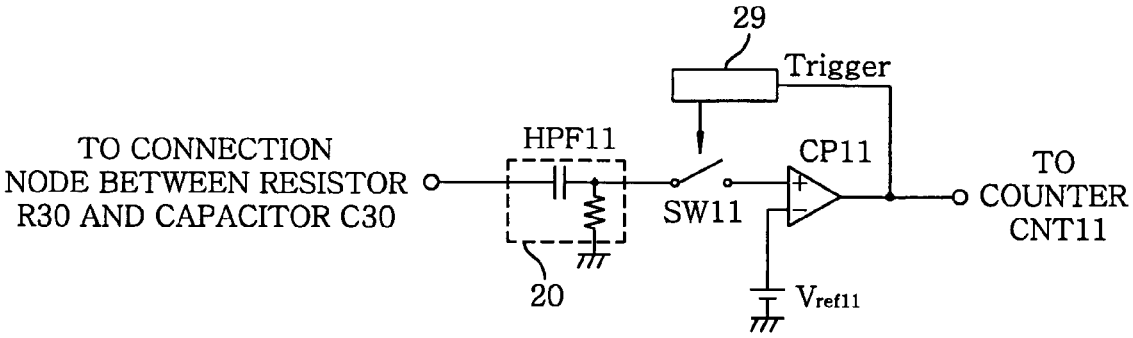
FIG. 20 describes a partial circuit diagram in accordance with a ninth preferred embodiment of the present invention.
Figure 21:
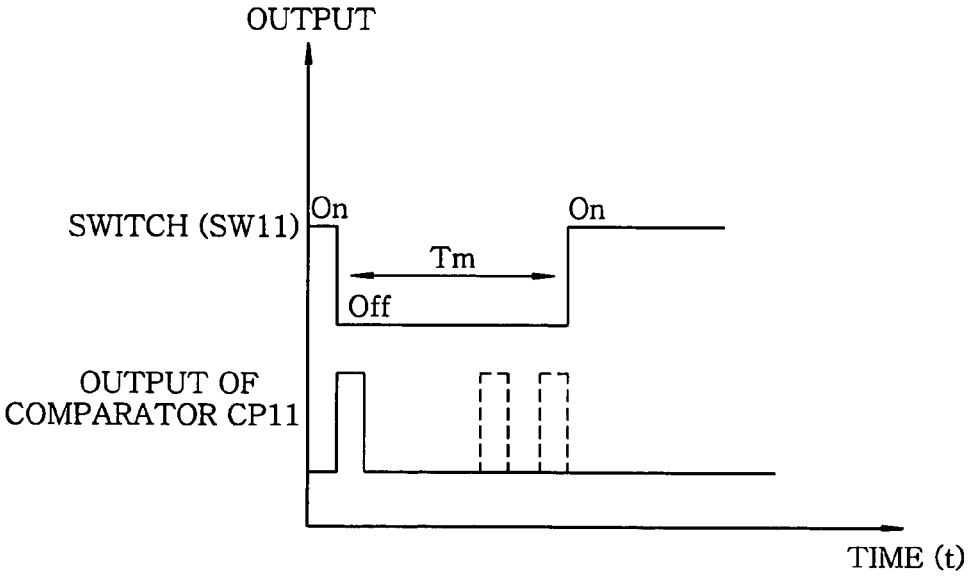
FIG. 21 provides signal waveforms of a switch SW11 and the comparator CP11 in the ninth preferred embodiment.

A ninth preferred embodiment of the present invention will now be presented with reference to FIGS. 20 and 21. FIG. 20 describes a partial circuit diagram of the preferred embodiment and FIG. 21 provides signal waveforms of a switch SW11 and the comparator CP11 in the preferred embodiment.

In the ninth preferred embodiment, the switch SW11 is installed between the high pass filter 20 and the comparator CP11; an input terminal of a timer 29 is connected to the output terminal of the comparator CP11; and an output terminal of the timer 29 is connected to a switching terminal of the switch SW11.

In this configuration, if the comparator CP11 detects afluctuation of the DC voltage component applied to the discharge lamp La10 and outputs a signal, the timer 29 receives the signal and makes the switch SW11 to be in an off-state during a specific time duration Tm as shown in FIG. 21. Since the switch SW11 is in the off-state, the comparator CP11 does not output a signal. And, after the specific time duration Tm has passed, the switch SW11 returns to an on-state, and the fluctuation of the DC voltage component applied to the discharge lamp La10 is inputted to the comparator CP11.

As described above, since generation of the output signal of the comparator CP11 is halted during the specific time duration Tm by the timer 29 and the switch SW11, the discharge lamp La10 can be prevented from being abruptly supplied with power by the driving circuit 17, so that an abrupt change of an optical output of the discharge lamp La10 can be prevented.

In addition, although the preferred embodiment employs the timer 29 and the switch SW11, same effects can be obtained by employing a low pass filter with a large time constant between the counter CNT11 and the comparator CP11.

Figure 22:
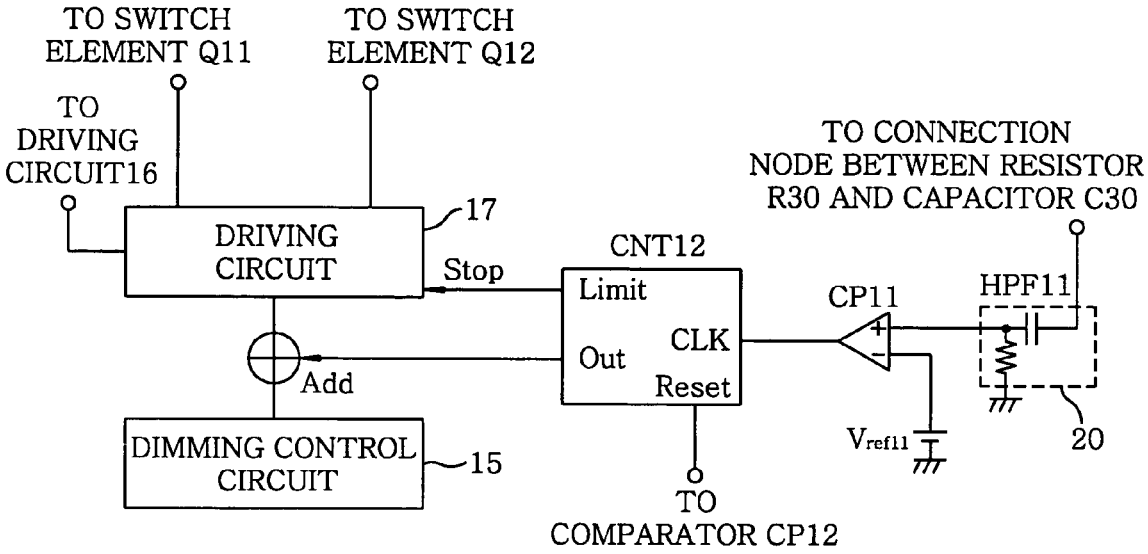
FIG. 22 depicts a partial circuit diagram in accordance with a tenth preferred embodiment of the present invention.
Figure 23:
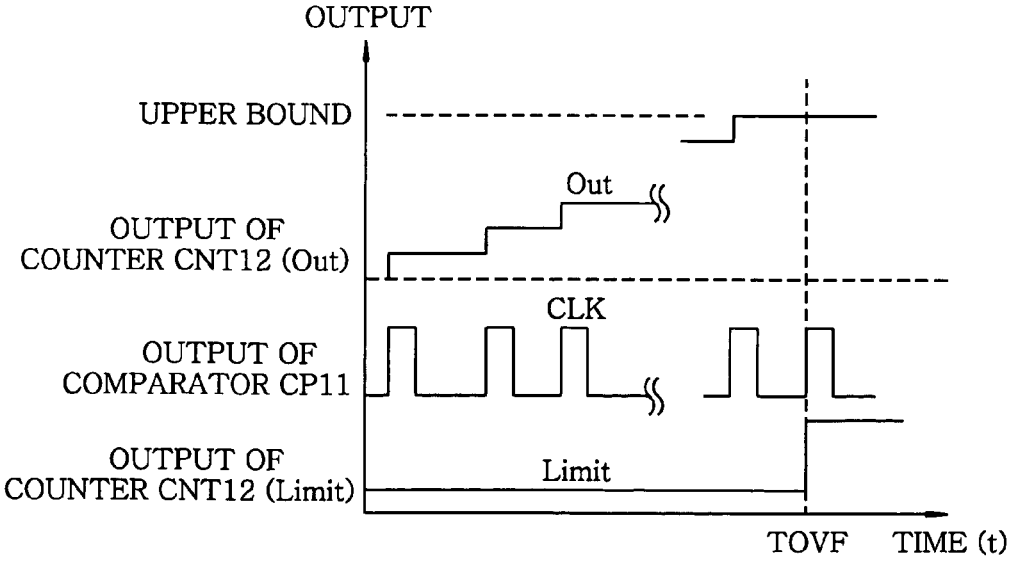
FIG. 23 offers output signals of a counter CNT12 and the comparator CP11 in the tenth preferred embodiment.

A tenth preferred embodiment of the present invention will now be described with reference to FIGS. 22 and 23. FIG. 22 depicts a partial circuit diagram of the preferred embodiment, and FIG. 23 offers output signals of a counter CNT12 and a comparator CP11 in the tenth preferred embodiment.

In the tenth preferred embodiment, the counter CNT11 is replaced with a counter CNT12 having a limit terminal connected to the driving circuit 17.

In this configuration, the comparator CP11 detects a fluctuation of the DC voltage component applied to the discharge lamp La10, and outputs a signal to the counter CNT12. As shown in FIG. 23, the counter CNT12 counts the signal from the comparator CP11. And, if the count reaches to a specific upper bound, a signal is outputted from the limit terminal of the counter CNT12. The driving circuit 17 receives the signal from the limit terminal of the counter CNT12, and stops a driving signal, whereby a switching of the switching elements Q11 and Q12 is stopped to turn off the discharge lamp La10.

By the above operation, if the flickering persists despite of increasing an input power to the discharge lamp La10 due to, for example, a degradation thereof, the discharge lamp La10 can be turned off, resulting in a forced stop of the flicking.

Figure 24:
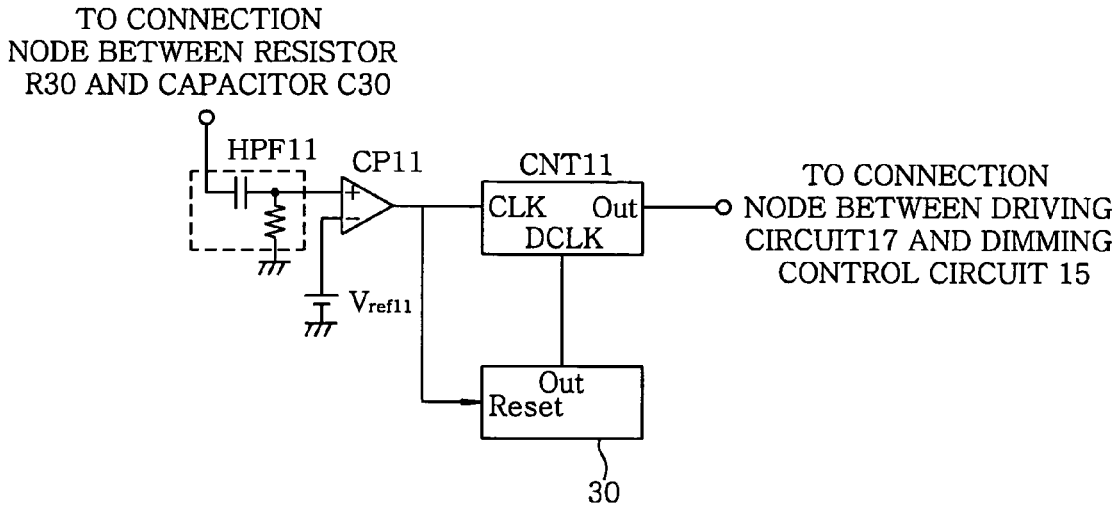
FIG. 24 illustrates a partial circuit diagram in accordance with a eleventh preferred embodiment of the present invention.
Figure 25:
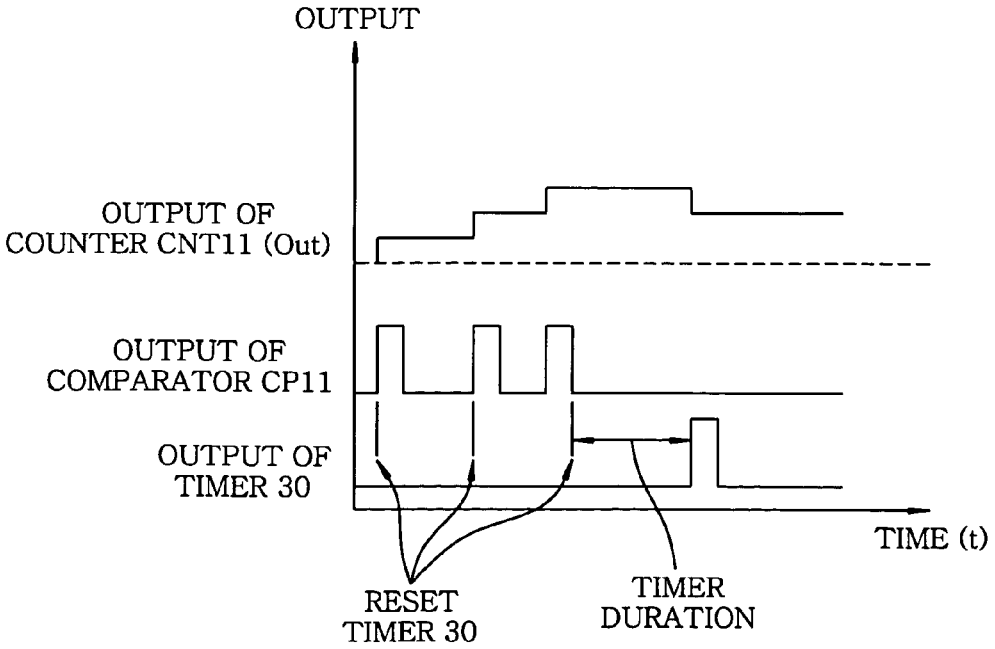
FIG. 25 shows an output signal of the comparator CP11, an output signal of the counter CNT11, and an output signal of a timer 30 in the eleventh preferred embodiment.

An eleventh preferred embodiment of the present invention will now be presented with reference to the FIGS. 24 and 25. FIG. 24 illustrates a partial circuit diagram of the preferred embodiment, and FIG. 25 shows output signals of the comparator CP11, the counter CNT11, and a timer 30 in the eleventh preferred embodiment.

In the eleventh embodiment, in order to count down a count of the counter CNT11 after a specific time duration, a reset terminal of the timer 30 is connected to an output terminal of the comparator CP11, and an output terminal of the timer 30 is connected to a DCLK terminal of the counter CNT11.

In this configuration, the comparator CP11 detects a fluctuation of a DC voltage component applied to the discharge lamp La10, and outputs a signal to the counter CNT11. The counter CNT11 receives and counts the signal from the comparator CP11. At the same time, the timer 30 is reset by the signal from the comparator CP11, and starts to measure a time thereafter. If the comparator CP11 does not output a signal during a specific time duration after that, the timer 30 outputs a signal to the counter CNT11 to decrease the count thereof, and is reset. Here, the specific time duration is set to be equal to or longer than 1 second because of filter characteristics of the fluctuation voltage detection circuit 18.

In this way, just after an ignition of the discharge lamp La10 when a flickering is apt to occur, an input power to the discharge lamp La10 is set to be high and after a specific time duration has passed, the input power to the discharge lamp is set to be lowered. Therefore, a lower bound of dimming can be maintained all the time without flickering.

While the invention has been shown and described with respect to the preferred embodiments, it will be understood by those skilled in the art that various changes and modifications may be made without departing from the spirit and scope of the invention as defined in the following claims.

What is claimed is:

1. A discharge lamp lighting device comprising:

a high frequency power supply for supplying a high frequency power to a discharge lamp via a first impedance element;

a DC power supply for applying a DC voltage to the discharge lamp via a second impedance element;

a dimming control circuit for carrying out a dimming of the discharge lamp by controlling a power supplied to the discharge lamp;

a DC voltage detection circuit for detecting a DC voltage component applied to the discharge lamp; and an output correction unit for making a correction to the power supplied to the discharge lamp according to a value detected by the DC voltage detection circuit, wherein the output correction unit raises an output to the discharge lamp if the DC voltage component applied to the discharge lamp has increased, and reduces the output to the discharge lamp if the DC voltage component applied to the discharge lamp has decreased.

2. The discharge lamp lighting device of claim 1, wherein the output correction unit controls an output to the discharge lamp by controlling an impedance value of the second impedance element.

3. The discharge lamp lighting device of claim 1, wherein the output correction unit makes the correction to the power supplied to the discharge lamp in proportion to the value detected by the DC voltage detection circuit.

4. The discharge lamp lighting device of claim 1, wherein the DC voltage detection circuit is coupled to one of the discharge lamp and the second impedance element.

5. The discharge lamp lighting device of claim 4, wherein the DC voltage detection circuit includes a low pass filter formed of a resistor and a capacitor.

6. A discharge lamp lighting device comprising:

a high frequency power supply for supplying a high frequency power to a discharge lamp via a first impedance element;

a DC power supply for applying a DC voltage to the discharge lamp via a second impedance element;

a dimming control circuit for carrying out a dimming of the discharge lamp by controlling a power supplied to the discharge lamp;

a DC voltage detection circuit for detecting a DC voltage component applied to the discharge lamp; and an output correction unit for making a correction to the power supplied to the discharge lamp according to a value detected by the DC voltage detection circuit, wherein the output correction unit controls an output to the discharge lamp by clamping the value detected by the DC voltage detection circuit at a predetermined value.

7. A discharge lamp lighting device comprising:

a high frequency power supply for supplying a high frequency power to a discharge lamp via a first impedance element;

a DC power supply for applying a DC voltage to the discharge lamp via a second impedance element;

a dimming control circuit for carrying out a dimming of the discharge lamp by controlling a power supplied to the discharge lamp;

a DC voltage detection circuit for detecting a DC voltage component applied to the discharge lamp; and an output correction unit for making a correction to the power supplied to the discharge lamp according to a value detected by the DC voltage detection circuit, wherein the output correction unit controls an output to the discharge lamp by controlling an impedance value of the second impedance element, and wherein the impedance value of the second impedance element is adjusted by controlling a duty ratio of a driving signal to drive a switch element connected in series or in parallel to the discharge lamp.

8. A discharge lamp lighting device comprising:

a high frequency power supply for supplying a high frequency power to a discharge lamp via a first impedance element;

a DC power supply for applying a DC voltage to the discharge lamp via a second impedance element;

a dimming control circuit for carrying out a dimming of the discharge lamp by controlling a power supplied to the discharge lamp;

a DC voltage detection circuit for detecting a DC voltage component applied to the discharge lamp; and an output correction unit for making a correction to the power supplied to the discharge lamp according to a value detected by the DC voltage detection circuit, wherein the output correction unit includes a fluctuation voltage detection circuit for detecting a fluctuation of the DC voltage component applied to the discharge lamp, and if the fluctuation voltage detection circuit detects an increase of the fluctuation of the DC component, the output correction unit increases the power to the discharge lamp.

9. The discharge lamp lighting device of claim 8, wherein the fluctuation voltage detection circuit includes a filter for detecting the fluctuation of the DC component of a frequency of 1 to 100 Hz.

10. The discharge lamp lighting device of claim 8, wherein the fluctuation voltage detection circuit determines the fluctuation based on a reference voltage varying according to the DC voltage component applied to the discharge lamp.

11. A discharge lamp lighting device comprising:

a high frequency power supply for supplying a high frequency power to a discharge lamp via a first impedance element;

a DC power supply for applying a DC voltage to the discharge lamp via a second impedance element;

a dimming control circuit for carrying out a dimming of the discharge lamp by controlling a power supplied to the discharge lamp;

a DC voltage detection circuit for detecting a DC voltage component applied to the discharge lamp; and an output correction unit for making a correction to the power supplied to the discharge lamp according to a value detected by the DC voltage detection circuit, wherein the output correction unit includes a fluctuation voltage detection circuit for detecting a fluctuation of the DC voltage component applied to the discharge lamp and a frequency detection circuit for detecting a frequency of the fluctuation of the DC voltage component detected by the fluctuation voltage detection circuit, and if the frequency of the fluctuation of the DC voltage component is within a specific frequency range, the output correction unit increases a DC power or an AC power to the discharge lamp until the frequency of the fluctuation goes out of the specific frequency range.

* * * * *